US005813198A

United States Patent [19]

Weder et al.

[11] Patent Number: 5,813,198

[45] **Date of Patent: *Sep. 29, 1998**

[54] POT WRAPPING APPARATUS AND METHOD

[75] Inventors: Donald E. Weder; Joseph G. Straeter, both of Highland, Ill.

[73] Assignee: Southpac Trust International, Inc.

[ * ] Notice: The term of this patent shall not extend beyond the expiration date of Pat. No. 5,647,193.

[21] Appl. No.: 854,046

[22] Filed: May 8, 1997

Related U.S. Application Data

[63] Continuation of Ser. No. 402,687, Mar. 13, 1995, Pat. No. 5,647,193.

[51] Int. Cl.[6] ..... B65B 11/04; B65B 25/02

[52] U.S. Cl. ..... 53/465; 53/397; 53/214

[58] Field of Search ..... 53/465, 461, 464, 53/214, 211, 587, 397, 399, 212, 389.4, 389.3, 389.2, 419, 137.2, 449, 174, 390; 206/423; 493/296, 303, 304, 112

[56] References Cited

U.S. PATENT DOCUMENTS

| | | | |
|---|---|---|---|
| 1,044,260 | 11/1912 | Schloss | 206/423 |
| 2,165,354 | 7/1939 | Duane et al. | 93/3 |
| 2,186,073 | 1/1940 | Johnson | 493/112 |
| 2,631,417 | 3/1953 | Harrison | 53/92 |
| 2,867,956 | 1/1959 | Murrell | 53/296 |
| 3,494,095 | 2/1970 | Valvano | 53/32 |
| 3,514,920 | 6/1970 | Hoffler et al. | 53/64 |
| 3,605,573 | 9/1971 | Buhle | 493/296 |
| 3,716,964 | 2/1973 | Reynolds et al. | 53/389 |
| 3,851,443 | 12/1974 | Fine | 53/139.3 |
| 4,152,879 | 5/1979 | Shulman | 53/399 |
| 4,170,172 | 10/1979 | Wommelsdorf | 93/94 |
| 4,204,377 | 5/1980 | Lancaster et al. | 53/399 |
| 4,387,552 | 6/1983 | Lancaster et al. | 53/556 |
| 4,409,776 | 10/1983 | Usui | 53/399 |
| 4,458,467 | 7/1984 | Shulman et al. | 53/399 |
| 4,502,264 | 3/1985 | Flaherty | 53/399 |
| 4,545,182 | 10/1985 | McDowell, Jr. | 53/556 |
| 4,549,388 | 10/1985 | Lancaster | 53/556 |
| 4,553,374 | 11/1985 | Lancaster et al. | 53/465 |
| 4,591,403 | 5/1986 | Von-Meyer | 156/364 |
| 4,620,408 | 11/1986 | Parnes | 53/77 |
| 4,662,151 | 5/1987 | Mathes et al. | 53/399 |
| 4,716,709 | 1/1988 | Lamb, Sr. et al. | 53/399 |
| 4,722,170 | 2/1988 | Ball et al. | 53/556 |
| 4,726,172 | 2/1988 | Widenback | 53/399 |
| 4,765,120 | 8/1988 | Phillips | 53/441 |
| 4,845,920 | 7/1989 | Lancaster | 53/399 |
| 4,862,678 | 9/1989 | Humphrey | 53/556 |
| 4,934,123 | 6/1990 | Salzsauler | 53/399 |
| 4,972,627 | 11/1990 | Hori et al. | 206/423 |
| 4,989,396 | 2/1991 | Weder et al. | 53/397 |
| 4,995,224 | 2/1991 | Yourgalite et al. | 53/540 |
| 5,059,136 | 10/1991 | Visentin | 493/296 |
| 5,105,599 | 4/1992 | Weder | 53/399 |
| 5,111,638 | 5/1992 | Weder | 53/465 |
| 5,155,970 | 10/1992 | Moore | 53/399 |
| 5,168,691 | 12/1992 | Errani | 53/587 |
| 5,199,242 | 4/1993 | Weder et al. | 53/397 |
| 5,199,246 | 4/1993 | Rodrigo | 53/449 |
| 5,235,792 | 8/1993 | Hanagata | 53/141 |
| 5,245,814 | 9/1993 | Weder | 53/465 |
| 5,307,605 | 5/1994 | Strateter | 53/465 |
| 5,365,723 | 11/1994 | Ramos | 53/556 |
| 5,617,708 | 4/1997 | Weder et al. | 53/465 |
| 5,647,193 | 7/1997 | Weder et al. | 53/465 |

*Primary Examiner*—James F. Coan
*Attorney, Agent, or Firm*—Dunlap & Codding, P.C.

[57] ABSTRACT

An apparatus and method for covering a flower pot by automatically providing a sheet of material in a vertical or semi-vertical orientation and automatically wrapping the sheet about the flower pot.

16 Claims, 9 Drawing Sheets

POT WRAPPING APPARATUS AND METHOD

CROSS REFERENCE TO RELATED APPLICATIONS

The present application is a continuation of U.S. Ser. No. 08/402,687, filed Mar. 13, 1995, now U.S. Pat. No. 5,647,193, entitled "Pot Wrapping Apparatus and Methods".

FIELD OF INVENTION

The present invention comprises an apparatus and method for using a sheet of material to wrap a pot or potted plant, particularly a frusto-conically shaped pot wherein the sheet is delivered to the pot in a vertical or semi-vertical orientation.

DESCRIPTION OF THE PREFERRED EMBODIMENTS

Figure 1:
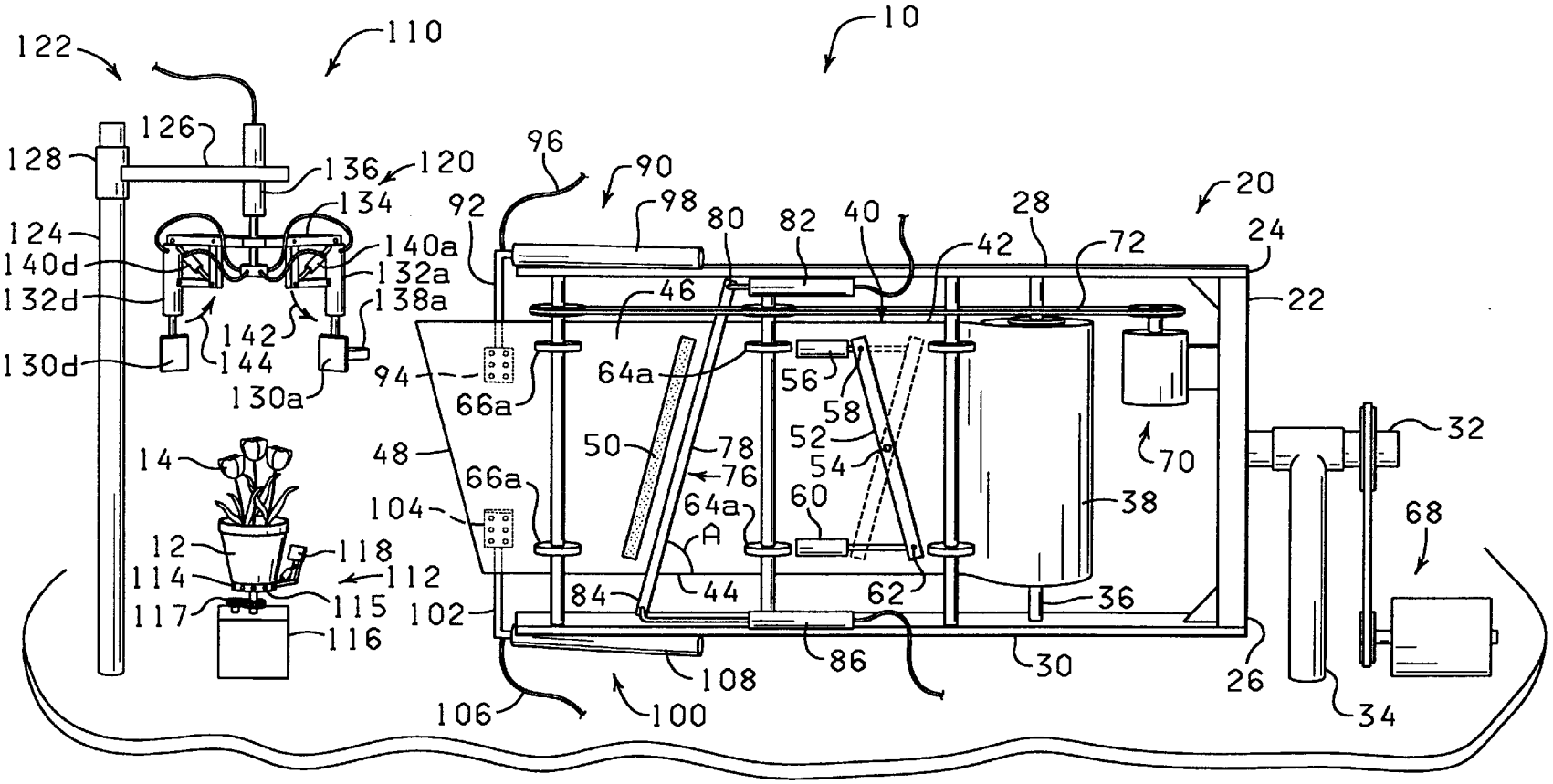
FIG. 1 is a side view of the apparatus constructed in accordance with the present invention.

The present invention contemplates a method of wrapping a sheet of material about a pot having an outer peripheral surface and a bottom surface, the pot typically having a plant disposed therein. The sheet preferably has a leading edge, a trailing edge, a lower edge and an upper edge. The method includes the steps of (1) disposing the pot upon a rotatable support surface, (2) automatically advancing the leading edge of the sheet of material toward the pot until a portion of the sheet of material is engaged in a vertical or semi-vertical wrapping position near the pot, and (3) rotating the rotatable support surface and the pot thereon through at least about one rotation drawing the sheet of material about the outer peripheral surface of the pot until the leading edge of the sheet engages a bonding material on another portion of the sheet of material thereby connecting the leading edge to the other portion of the sheet wherein the sheet of material circumferentially encompasses at least a portion of the outer peripheral surface of the pot.

The step of automatically advancing the sheet of material may further comprise providing a roll of material and severing a portion of the roll of material to form the sheet of material. In the step of automatically advancing the sheet, the sheet may further comprise a pot bonding material thereon and when the sheet is advanced toward the pot, the pot bonding material engages the pot and bondingly connects a portion of the sheet to the pot. The step of rotating the rotatable surface may be preceded by applying the bonding material to a portion of the sheet of material.

In the advancing step, the sheet of material may be engaged by an engaging assembly (holding means) for holding the portion of the sheet of material in a position adjacent the pot. The engaging assembly may further comprise a clamping device for clamping a portion of the sheet of material against the outer peripheral surface of the pot or against the turntable. Alternatively, the engaging assembly may further comprise means in the turntable for exerting a suction force upon a portion of the sheet.

Also, the engaging assembly may comprise a wrapping cage positioned above the pot for holding a portion of the upper end of the sheet of material in a vertical or semi-vertical position above the pot while the sheet is drawn about the pot. In this case, the wrapping cage positioned above the pot is rotated synchronously with the rotatable support surface in the rotating step. Further, in the rotating step, the sheet of material may be wrapped about the pot such that the sheet of material substantially encompasses the entire outer peripheral surface of the pot. Additionally, in the rotating step, a portion of the sheet of material may be positioned to extend a distance above the pot. Also, the pot may be further defined as containing a botanical item which extends from the pot wherein the portion of the sheet of material extending above the pot substantially surrounds the botanical item when the sheet is wrapped about the pot.

The method may further comprise the step of sealing together the upper edge of the sheet of material for closing the sheet of material about the botanical item. Also, in the advancing step, the sheet of material may be advanced toward the pot at an angle which is substantially the same as an angle between the rotatable support surface and the outer peripheral surface of the pot. Additionally, after the sheet is wrapped about the pot, a band may be applied to hold the sheet about the pot, or a crimped portion may be formed in the wrapper to hold the wrapper about the pot.

The invention further contemplates a method of wrapping a sheet of material about a floral grouping having a stem end and a bloom end and the sheet having a leading edge, a trailing edge, a lower edge and an upper edge. The method includes the steps of (1) placing the floral grouping in a generally vertical or semi-vertical orientation, (2) automatically advancing the leading edge of the sheet of material toward the floral grouping until a portion of the sheet of material is engaged in a vertical or semi-vertical wrapping position near the floral grouping, and (3) rotating the floral grouping through about one rotation drawing the sheet of material about the floral grouping until the leading edge of the sheet engages a bonding material on another portion of the sheet of material thereby connecting the leading edge to the other portion of the sheet wherein the sheet of material surrounds at least a portion of the floral grouping between the stem end and the bloom end.

The step of automatically advancing the sheet of material may further comprise providing a roll of material and severing a portion of the roll of material to form the sheet of material. Also, the sheet of material may be crimped about a portion of the floral grouping after the sheet has been wrapped about the floral grouping. Further, the step of rotating the floral grouping may be preceded by applying the bonding material to a portion of the sheet of material. In the advancing step, the sheet of material may be engaged by an engaging (holding) assembly for holding the portion of the sheet of material in a position near the floral grouping. Also, the engaging assembly may further comprise a clamping device for clamping a portion of the sheet of material against the turntable or against the outer peripheral surface of a container disposed upon the turntable into which the stem end of the floral grouping is disposed.

The engaging assembly may further comprise means for exerting a suction force upon a portion of the sheet. The engaging assembly may further comprise a wrapping cage positioned above the floral grouping for holding a portion of the upper end of the sheet of material in a vertical or semi-vertical position above the bloom end while the sheet is drawn about the floral grouping. The wrapping cage positioned above the floral grouping may be rotated synchronously with the floral grouping. Preferably, in the rotating step, the sheet of material is wrapped about the floral grouping such that the sheet of material substantially encompasses the entire floral grouping. Also, in the rotating step, a portion of the sheet of material may be positioned to extend a distance above the bloom end of the floral grouping. The upper edge of the sheet of material may be sealed together for closing the sheet of material above the bloom end of the floral grouping. Also, the sheet of material may be sealed below the stem end after the sheet has been wrapped about the floral grouping. A band may be applied about the sheet of material after the sheet is wrapped about the floral grouping. Alternatively, a portion of the sheet of material may be crimped about the floral grouping after the sheet of material has been wrapped about the floral grouping.

The present invention further contemplates a method of forming a cover which can be used to wrap a potted plant or floral grouping from a sheet of material. The method includes the steps of (1) providing a mold having an outer peripheral surface, (2) automatically advancing the leading edge of the sheet of material toward the mold until a portion of the sheet of material is engaged in a vertical or semi-vertical wrapping position adjacent the mold, (3) rotating the sheet of material through at least about one rotation drawing the sheet of material about the outer peripheral surface of the mold until the leading edge of the sheet engages a bonding material on another portion of the sheet of material thereby connecting the leading edge to the other portion of the sheet wherein the sheet of material circumferentially encompasses at least a portion of the outer peripheral surface of the mold forming a tubular cover, and (4) removing the tubular cover from about the mold.

The method may include the additional step of closing one end of the tubular cover to form a cover having a closed bottom. The sheet may be provided from a roll of material from which a portion is severed to form the sheet of material. The rotating step may be preceded by applying the bonding material to a portion of the sheet of material.

Further, in the advancing step the sheet of material may be engaged by an engaging assembly for holding the portion of the sheet of material. The engaging assembly may further comprise a clamping device for clamping a portion of the sheet of material against the outer peripheral surface of the mold. The engaging assembly means may comprise means in the mold for exerting a suction force upon a portion of the sheet to hold the sheet against the mold. Also, the engaging assembly may comprise a wrapping cage positioned above the mold for holding a portion of the upper end of the sheet of material in a vertical or semi-vertical position above the mold while the sheet and the mold are rotated. The rotating step may further comprise rotating the mold synchronously with the sheet of material as the sheet of material is rotated. Also, in the rotating step the sheet of material may be wrapped about the mold such that the sheet of material substantially encompasses the entire outer peripheral surface of the mold. Additionally, in the rotating step, a portion of the sheet of material may be positioned to extend a distance from an end of the mold.

The present invention further contemplates an apparatus for wrapping a sheet of material about a pot having an outer peripheral surface and a bottom surface or about a floral grouping. More particularly, the apparatus comprises (1) a rotatable support surface for rotating a pot or floral grouping disposed in a vertical or semi-vertical position thereon, (2) a sheet support assembly for supporting the sheet of material and for advancing the leading edge of the sheet of material toward the pot or floral grouping to a vertical or semi-vertical wrapping position, (3) an engaging assembly for holding a portion of the sheet of material in a wrapping position about the pot or floral grouping in a position adjacent the rotatable support surface, (4) a wrapping cage or for holding a portion of the sheet of material in a position extending above the pot or floral grouping, and (5) wherein the rotatable support surface, the engaging assembly, and the wrapping cage can be rotated synchronously for wrapping the sheet of material circumferentially about the pot or floral grouping.

The sheet support assembly may further comprise means for supporting a roll of material and cutting means for cutting a portion of the roll of material to provide the sheet of material. The apparatus may further comprise a bonding material applicator for applying a bonding material to a portion of the sheet of material. The engaging assembly may further comprise a clamping device for clamping a portion of the sheet of material against the outer peripheral surface of the pot or against the turntable. The engaging assembly may comprise means in or on the turntable for exerting a suction force upon a portion of the sheet and holding the sheet to the turntable. The wrapping cage may comprise vacuum means for exerting a suction force against the sheet of material in a position above the pot. The sheet support assembly is rotatable to a vertical or semi-vertical angle which is substantially the same as an angle between the rotatable support surface and the outer peripheral surface of the pot or floral grouping.

The following constitutes further detailed description of the various embodiments of the invention.

Embodiments of FIGS. 1–12F

Shown in FIG. 1 is an item wrapping apparatus constructed in accordance with the present invention and generally designated by the reference numeral 10. Shown therein is an item 12 positioned for wrapping by the apparatus 10. As indicated in FIG. 1, the item 12 preferably comprises a frusto-conically shaped pot partially containing a botanical item such as a potted plant 14. The pot and the plant 14 shown in FIG. 1 are used solely by way of illustration and not by way of limitation. For example, the item 12 may comprise any container, generally symmetrical about a vertical axis, especially wherein the cross sectional diameter of a sidewall of the container is either the same or greater than the cross sectional diameter of the base of the container. The item 12 preferably may comprise a floral grouping, a flower pot, or other container, or a mold, and the plant 14 may consist of any botanical item as defined elsewhere herein. Instead of a plant, the pot or item 12 may contain other materials such as materials relating to celebrations including baskets, Easter eggs, Easter grass, stuffed animals. The contained item may comprise foods, such as fruit, cheese, smoked ham, turkeys, or parts thereof. The apparatus 10 operates to wrap the item 12 in a manner which allows the plant 14 to be generally free of intimate contact with a wrapping material, but which affords a degree of protection to the plant 14, presents a festive or decorative appearance, and allows the item 12 to be transported by an operator.

As shown in FIG. 1, the apparatus 10 includes a sheet delivery assembly 20 positioned in a generally vertical or semi-vertical orientation for delivering a sheet at an angle which is defined herein as any angle between and including 0° and 90°. The sheet delivery assembly 20 includes a vertical support member 22 having a first end 24 and a second end 26. A first horizontal support 28 is connected to the first end 24 of the vertical support member 22, and a second horizontal support 30 is connected to the second end 26 of the vertical support member 22. A rotatable shaft 32 is connected to the vertical support member 22, generally between the first end 24 and the second end 26. The rotatable shaft 32 operates to rotatably support the sheet delivery assembly 20, via a support 34, a distance from a surface.

The sheet delivery assembly 20 further includes a receiving roller 36 rotatably connected to the first horizontal support 28 and the second horizontal support 30. The receiving roller 36 is adapted to receive a roll 38 comprising a continuous web of wrapping material, a portion 40 which is unrolled. The unrolled portion 40 of wrapping material has a first edge 42, a second edge 44, a first surface 46, a second surface 47 and a leading edge 48.

The web of material comprising the roll 38 shown in FIG. 1 may have one or more areas of bonding material 50 already disposed at predetermined positions thereon. Shown on the unrolled portion 40 is one area of bonding material 50, but additional areas of bonding material may be disposed at regular intervals on one surface of the web 40. Preferably, the area of bonding material 50 is disposed on the roll 38 in such a manner that each sheet of material cut from the roll 38 has at least one area of bonding material 50 disposed thereon.

In another embodiment of the invention, as shown in FIG. 1, the roll of wrapping material 38 will not have a bonding material already upon the wrapping material therein. In this embodiment of the invention, at least one bonding material applicator 52 is attached to the sheet delivery assembly 20 or is provided separately for disposing an area of bonding material 50 on at least one side of the unrolled portion 40 of the roll of wrapping material 38.

The term "bonding material or bonding means" when used herein means an adhesive, frequently a pressure sensitive adhesive, or a cohesive. When the bonding material is a cohesive, a similar cohesive material must be placed on an adjacent surface for bondingly contacting and bondingly engaging with the cohesive material. The term "bonding material or bonding means" also includes materials which are heat sealable and, in this instance, the adjacent portions of the material must be brought into contact and then heat must be applied to effect the seal. The term "bonding material or bonding means" also includes materials which are sonic sealable and vibratory sealable. The term "bonding material or bonding means" when used herein also means a heat sealing lacquer or hot melt material which may be applied to the material and, in this instance, heat, sound waves, or vibrations, also must be applied to effect the sealing.

Alternatively, a cold seal adhesive may be utilized as the bonding material or means. The cold seal adheres only to a similar substrate, acting similarly as a cohesive, and binds only to itself. The cold seal adhesive, since it bonds only to a similar substrate, does not cause a residue to build up on equipment, thereby both permitting much more rapid disposition and use of such equipment to form articles and reducing labor costs. Further, since no heat is required to effect the seal, the dwell time, that is, the time for the sheet of material to form and retain the desired shape is reduced. A cold seal adhesive binds quickly and easily with minimal pressure, and such a seal is not readily releasable. This characteristic is different from, for example, a pressure sensitive adhesive.

In certain embodiments which function in accordance with the present invention, the term "bonding material or bonding means" when used herein may also mean any heat or chemically shrinkable material, and static electrical or other electrical means, chemical welding means, magnetic means, mechanical or barb-type fastening means or clamps, curl-type characteristics of the film or materials incorporated in material which can cause the material to take on certain shapes, cling films, slots, grooves, shrinkable materials and bands, curl materials, springs and any type of welding method which may weld portions of the material to itself or to the pot, or to both the material itself and the pot. The pot itself may come equipped with bonding materials such as described herein.

The roll 38 is constructed from any suitable flexible material that is capable of being unrolled, cut by means of the current invention, and wrapped about an item 12.

The web material from which the unrolled portion 40 is constructed preferably has a thickness in a range from about 0.1 mils to about 30 mils, although in some cases the material may be much thicker, especially when the material is constructed from multiple layers. Often, the thickness of the material is in a range from about 0.5 mils to about 10 mils. Preferably, the material has a thickness in a range from about 1.0 mil to about 5 mils. More preferably, the material is constructed from material which is flexible or semi-rigid. The material may be constructed of a single layer of material or a plurality of layers of the same or different types of materials. Any thickness of the material may be utilized as long as the material functions in accordance with the present invention as described herein. The layers of material comprising the material may be connected together or laminated or may be separate layers. Such materials used to construct the material are described in U.S. Pat. No. 5,111,637 entitled "Method For Wrapping A Floral Grouping" issued to Weder et al., on May 12, 1992, which is hereby incorporated herein by reference. Any thickness of material may be utilized in accordance with the present invention as long as the material may be formed as described herein, and as long as the sheet of material may be formed about a pot or potted plant or a floral grouping, as described herein. Additionally, an insulating material such as bubble film, preferable as one of two or more layers, can be utilized in order to provide additional protection for the item, such as the floral grouping, contained therein.

In one embodiment, the material may be constructed from two polypropylene films. The material may be connected together or laminated or may be separate layers. In an alternative embodiment, the material may be constructed from only one of the polypropylene films.

The material may also be constructed, in whole or in part, from a cling material, "Cling Wrap or Material" when used herein means any material which is capable of connecting to the sheet of material and/or itself upon contacting engagement during the wrapping process and is wrappable about an item whereby portions of the cling material contactingly engage and connect to other portions of another material, or, alternatively, itself, for generally securing the material wrapped about at least a portion of a pot or floral grouping. This connecting engagement is preferably temporary in that the material may be easily removed, i.e., the cling material "clings" to the pot or floral grouping.

The cling material is constructed and treated if necessary, from polyethylene such as Cling Wrap made by Glad®, First Brands Corporation, Danbury, Conn. The thickness of the cling material will, in part, depend upon the size of the sheet and the size of the pot. Generally, a larger pot may require a thicker and therefore stronger cling material. The cling material will range in thickness from less than about 0.1 mils to about 10 mils, and preferably less than about 0.5 mils to about 2.5 mils and most preferably from less than about 0.6 mils to about 2 mils. However, any thickness of cling material may be utilized in accordance with the present invention which permits the cling material to function as described herein.

The material is constructed from any suitable material that is capable of being wrapped about a pot and a floral grouping disposed therein. Preferably, the material comprises paper (untreated or treated in any manner), cellophane, metal foil, polymer film, non-polymer film, fabric (woven or nonwoven or synthetic or natural), cardboard, fiber, cloth, burlap, or laminations or combinations thereof.

The term "polymer film" means a man-made polymer such as a polypropylene or a naturally occurring polymer such as cellophane. A polymer film is relatively strong and not as subject to tearing (substantially non-tearable), as might be the case with paper or foil.

The material may vary in color and may consist of designs or decorative patterns which are printed, etched, and/or embossed thereon using inks or other printing materials. An example of an ink which may be applied to the surface of the material is described in U.S. Pat. No. 5,147,706 entitled "Water Based Ink On Foil And/Or Synthetic Organic Polymer" issued to Kingman on Sep. 15, 1992 and which is hereby incorporated herein by reference.

In addition, the material may have various coloring, coatings, flocking and/or metallic finishes, or other decorative surface ornamentation applied separately or simultaneously or may be characterized totally or partially by pearlescent, translucent, transparent, iridescent, neon, or the like, qualities. Each of the above-named characteristics may occur alone or in combination and may be applied to the upper and/or lower surface of the material. Moreover, portions of the material used may vary in the combination of such characteristics. The material may be opaque, translucent, transparent, or partially clear or tinted transparent.

The term "pot" as used herein refers to any type of container used for holding a floral grouping or plant. Examples of pots, used in accordance with the present invention include, but not by way of limitation, clay pots, wooden pots, plastic pots, pots made from natural mud/or synthetic fibers, or any combination thereof. The pot is adapted to receive a floral grouping in the retaining space. The floral grouping may be disposed within the pot along with a suitable growing medium described in further detail below, or other retaining medium, such as a floral foam.

The term "floral grouping" as used herein means cut fresh flowers, artificial flowers, a single flower or other fresh and/or artificial plants or other floral materials and may include other secondary plants and/or ornamentation or artificial or natural materials which add to the aesthetics of the overall floral grouping. The floral grouping comprises a bloom or foliage portion and a stem portion. Further, the floral grouping may comprise a growing potted plant having a root portion (not shown) as well. However, it will be appreciated that the floral grouping may consist of only a single bloom or only foliage, or a botanical item (not shown), or a propagule (not shown). The term "floral grouping" may be used interchangeably herein with both the terms "floral arrangement" and "potted plant". The term "floral grouping" may also be used interchangeably herein with the terms "botanical item" and/or "propagule."

The term "growing medium" when used herein means any liquid, solid or gaseous material used for plant growth or for the cultivation of propagules, including organic and inorganic materials such as soil, humus, perlite, vermiculite, sand, water, and including the nutrients, fertilizers or hormones or combinations thereof required by the plants or propagules for growth.

The term "botanical item" when used herein means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquet or floral grouping.

The term "propagule" when used herein means any structure capable of being propagated or acting as an agent of reproduction including seeds, shoots, stems, runners, tubers, plants, leaves, roots or spores.

The bonding material applicator 52 is shown in FIG. 1 as pivoting about a central point 54 about which the applicator 52 can be reciprocatingly pivoted by a first piston 56 attached to a first end 58 of the applicator 52 and by a second piston 60 attached to a second end 62 of the applicator 52. The position of the applicator 52 can then be manually or automatically adjusted to cause the bonding material to be disposed upon the unrolled portion 40 in any arrangement as desired. The area of bonding material 50 is shown in FIG. 1 as being disposed in a continuous strip. However, it will be understood by one of ordinary skill in the art that the area of bonding material may be discontinuous, or disposed in any of a variety of patterns such as spots, circles, dots or any other geometric or biomorphic shape, including decorative designs, as long as the area of bonding material is positioned to function in accordance with the present invention. Further, it will be appreciated that the bonding material applicator 52 shown in FIG. 1 is only one of a number of constructions or configurations known to those of ordinary skill in the art, for example spraying, which would be effective in applying a bonding material to the unrolled portion 40 of the roll 38 if such bonding material was not already applied to the web of material.

The sheet delivery assembly 20 further comprises means for advancing the unrolled portion 40 toward the item 12. The advancing means may comprise nip rollers 64*a* and 64*b* and nip rollers 66*a* and 66*b* as shown in FIGS. 1 and 2. The apparatus 10, in other embodiments of the invention, may comprise additional pairs of nip rollers or other driving means.

The sheet delivery assembly 20 further comprises a drive assembly 68 for rotating the rotatable shaft 32, thereby enabling the sheet delivery assembly 20 to be rotated about an axis of the rotatable shaft 32. The drive assembly 68 may comprise an electric motor, connected to the rotatable shaft 32, via belts and pulleys as shown. The sheet delivery assembly 20 may additionally comprise a brake (not shown), which operates to hold the sheet delivery assembly 20, via the rotatable shaft 32 in an immobilized position, when the sheet delivery assembly 20 has been rotated to a desired position.

The sheet delivery assembly 20 further comprises a drive assembly 70 for driving the nip rollers 64*a*, 64*b*, 66*a*, and 66*b* for advancing the unrolled portion of material 40. The drive assembly 70 may comprise an electric motor which is operatively connected to the nip rollers via a drive belt 72. The drive assembly 70 can be activated manually or automatically to advance the unrolled portion of material 40 in a manner appreciated by those of ordinary skill in the art.

The sheet delivery assembly 20 additionally comprises a cutting assembly 76, comprising a cutting means such as a razor 78 shown in FIG. 1. The razor 78 is connected at a first end 80 to a first cutter assembly piston 82 and at a second end 84 to a second cutter assembly piston 86, whereby the razor 78 can be reciprocatingly pivoted about its center to change its angular position relative to the unrolled portion of material 40. The razor 78 may be moved in a downward direction toward the unrolled portion 40 by means not shown, but well understood in the art, for effecting the shearing of the terminal portion of the unrolled portion of material 40 from the roll 38.

The sheet delivery assembly 20 also comprises a first gripper assembly 90 comprising a gripper arm 92 and a gripper plate 94. The gripper plate 94 comprises a plurality of holes and is connected to a vacuum source 96 which works to effect a suction against the plate 94. The gripper arm 92 is attached to a piston 98 which serves to reciprocatingly extend and retract the gripper arm 92 during operation of the apparatus 10. A second gripper assembly 100 comprises a gripper arm 102 and a gripper plate 104 attached to a vacuum source 106 for effecting a suction is connected to the horizontal bar 30. The gripper arm 102 is attached to a piston 108 which serves to reciprocatingly extend and retract the gripper arm 102 during operation of the apparatus in the same way as the first gripper assembly 90 but when the sheet delivery assembly 20 has been rotated.

The sheet delivery assembly 20 may additionally comprise a micropunch (not shown) which may be attached to the first horizontal member 28 or the second horizontal support member 30. The micropunch operates to punch a plurality of holes in the unrolled portion 40. The sheet delivery assembly 20 can additionally comprise a wrap support grate (not shown) which serves to support the unrolled portion 40 of the roll 38, as the unrolled portion 40 is being indexed by the first and/or second sets of nip rollers 64*a* and 64*b*, and 66*a* and 66*b*.

The sheet delivery assembly 20 may further comprise an ionized air blower (not shown) which is attached to either the first horizontal support member 28 or the second horizontal support member 30, and which operates by passing ionized air over the unrolled portion 40 to remove the static charges therefrom.

The apparatus 10 further comprises a wrapping assembly 110 which comprises a support surface or assembly 112 for supporting the item 12 to be wrapped. The support assembly 112 preferably comprises a turntable 114 and drive assembly 116 for turning the turntable 114.

In a preferred embodiment, the drive assembly 116 comprises a reversible electric motor, attached to cam wheels, such as the cam wheel 117 via a belt. The cam wheels 117 movably connects with the turntable 114, imparting rotation to the turntable 114 when the cam wheel 117 is turned via the drive assembly 116.

The turntable 114 preferably also comprises means for securing the item 12 to the turntable 114 such as a clip, spring or a rotating chuck (not shown). The support assembly 112 further comprises an engaging assembly for restraining or pressing a sheet against the outer surface of the item 12 or for holding or restraining the sheet in a stationary position relative to a point on the item 12. This may comprise a dog or clamp 118 which comprises a cylinder driven reciprocating arm which presses a portion of the sheet against the outer surface of the pot or other wrapper forming means. The engaging assembly may further comprise orifices 115 incorporated into the turntable 114 and which are connected to a vacuum source for causing a sheet to be held via a suction force against the outer edge of the turntable 114.

The wrapping assembly 110 further comprises a wrapping cage 120 which is supported by a cage support 122 in a position generally above the support assembly 112. The cage support 122 may comprise a post 124 and a beam 126 from which is suspended the wrapping cage 120. The beam 126 is movably connected to the post 124 by an adjustable sleeve 128 for adjusting the vertical or horizontal position of the wrapping cage 120 relative to the support assembly 112.

The wrapping cage 120 preferably comprises four sheet grippers (FIGS. 1 and 2) which have means for gripping portions of the sheet to be wrapped about the pot. In the version shown herein the sheet grippers are wrapper plates 130*a*, 130*b*, 130*c* and 130*d*. Each wrapper plate 130*a*–130*d* is attached to a piston cylinder (shown in FIG. 1 are cylinders 132*a* and 132*b* only) for reciprocatingly moving the wrapper plate attached thereto upwardly and downwardly. Each wrapper plate 130*a*–130*d* has a flat or slightly curved surface pierced by a plurality of holes (reflected in cross-section in FIG. 2 on the outer surface of the plate). The plate is attached to a vacuum source (not shown) for effecting a suction through the holes. The cylinders 132 which are attached to the sheet grippers 130*a*–130*d* are attached to a cross bar 134 which is attached to a cylinder 136 which can raise and lower the wrapping cage 120. The cylinder 136 is attached to the beam 126 described above. Each wrapper plate 130*a* and 130*b* has a guide roller 138*a* and 138*b*, respectively, which is pressable against a portion of the adjacent wrapper plate. Each guide roller 138*a* and 138*b* moves independently of the adjacent wrapper plate 130*a* and 130*b*, respectively, so that the guide rollers 138*a* and 138*b* can remain in a stationary position while the turntable 114 and the gripper plates 130*a*–130*d* of the wrapping cage 120 are rotating as described below. The rollers 138*a* and 138*b* may be adjustably attached to another portion of the wrapping assembly 110 such as the post 124 by means not shown but which are well known to those of ordinary skill in the art.

The wrapping cage 120 further comprises adjustors attached to the cylinders 132*a*–*d* such as adjustors 140*a* and 140*d* for adjusting the lateral position of the wrapper plates 130*a* and 130*d* relative to the item 12 when the item 12 is supported on the turntable 114. The wrapper plates 130*a* and 130*d* are shown in FIG. 1 in a partially extended position and can be extended further by being moved in a direction 142 or can be retracted into a retracted position by being moved in a direction 144.

The wrapping cage 120 further comprises actuating means (not shown) for actuating the cylinders 132*a*–*d*. In a preferred embodiment the cylinders 132*a*–*d* which are attached to the wrapper plates 130*a*–*d*, respectively, are air activated, and are operated to move the wrapper plates 130*a*–130*d* in an extended (downward) or retracted (upward) position.

In addition to the elements above described, the apparatus 10 consists of control means (not shown) for activating and controlling the sheet delivery assembly 20 and the wrapping assembly 110 by an operator. The control means may consist of electronic control paths, signal paths, and switches as are commonly found in the art. Additionally, the various operations of the apparatus 10 may be directed and controlled through a microprocessor. However, in a preferred embodiment of the invention, an operator will manually activate the apparatus 10, in order to cause the apparatus 10 to perform the functions required to wrap an item 12, as explained below.

FIG. 2 is a diagrammatic plan view of the apparatus 10. The roll of wrapping material 38 is supported by the receiving roller 36. An unrolled portion 40 of the roll of wrapping material 38 is advanced between the first set of nip rollers 64*a* and 64*b* and the second set of nip rollers 66*a* and 66*b*. The unrolled portion 40 of the roll 38 has a first surface 46 and a second surface 47 and a leading edge 48. The unrolled portion 40 is positioned to be cut by the razor cutter 78. As the unrolled portion 40 is advanced, a portion of the unrolled portion 40 near the leading edge 48 is gripped by the gripper plate 94 of the gripper arm 92 preparing the leading edge 48 to be fed between the wrapper plate 130*a* and the stationary guide roller 138*a*. A portion of the unrolled portion 40 of the roll of sheet material 38 near the leading edge 48 is gripped by the suction applied thereto through the holes of the wrapper plate 130*a*.

When the unrolled portion 40 is secured between the wrapper plate 130*a* and the guide roller 138*a* the suction which has been applied to the gripper plate 94 to secure the unrolled portion 40 thereby, is released, freeing the unrolled portion 40 from the gripper plate 94 whereby the gripper plate 94 is retracted.

The lower edge 44 of the unrolled portion 40, held by the wrapper plate 130*a* is caused to be attached to or held to a portion of the turntable 114 by a suction or dog or to the outer surface of the item 12 by a clamp or bonding material. The lower edge 44 may be held to the turntable 114 by a suction exerted through holes 115 in the outer edge of the turntable 114 or by a clipping mechanism which moves in concert with the turntable 114. Alternately, the lower edge 44 may be held against the outer surface of the item 12 by a bonding material on the sheet or pot or both, or by the clamp or dog 118 which may be attached to the turntable 114 and therefore which rotates in concert with the turntable 114 and the item 12 disposed thereon.

When the unrolled portion 40 of the roll of wrapping material 38 has been indexed to a predetermined length, it is cut by the cutter 78 whereby a sheet of material 150 is separated from the unrolled portion 40 forming a sheet having a leading edge 48 and a trailing edge 152 formed at the point of separation from the unrolled portion 40.

In an alternate version, this cutting step may be performed before the sheet of material 150 is advanced toward the wrapping assembly 110 and thus before the leading edge 48 is gripped by the wrapper plate 130*a*.

Once the leading edge 48 of the unrolled portion 40 has been engaged by the wrapper plate 130*a* and has been connected near or at its lower edge 44 to a position on the pot 12 or the turntable 114, the actual wrapping process can begin. The wrapping cage 120 functions to hold the upper end 42 of the sheet of material 150 in an upright position above the item 12 and the botanical item held therein so that a proper connection between the leading edge 48 and the trailing edge 152 of the sheet 150 will occur during the wrapping process. The turntable 114 and the wrapping cage 120 are rotated synchronously so that the lower edge 44 and the upper edge 42 of the sheet 150 turn in together. The pot 12 is rotated through at least about one complete rotation and optionally one or more additional partial or complete rotations.

FIGS. 3A–6B show how the sheet 150 is wrapped about the item 12 in one version of the operation of the present method. The wrapping cage 120 and the turntable 114 and item or pot 12 are rotated in a direction 146. Wrapper plate 130*a* having the sheet 150 attached thereto is advanced counter-clockwise about 90° from its position shown in FIG. 2 to its position shown in FIG. 3A. As the wrapper cage 120 is turned, wrapper plate 130*b* is also advanced about 90° and engages a portion of the sheet 150 as the wrapper plate 130*b* is moved into a position adjacent roller guide 138*a* which, as noted above, remains stationary. FIG. 3B shows the lower edge 44 of the sheet 150 clamped by clamp 118 against the pot 12, the pot 12 also having been rotated about 90°.

Figure 4A:
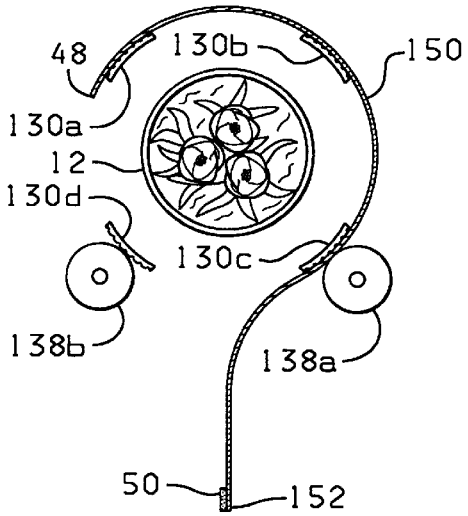
FIG. 4A is a plan view of the sheet and wrapping cage of FIG. 3A advanced about 90° counter-clockwise.
Figure 3B:
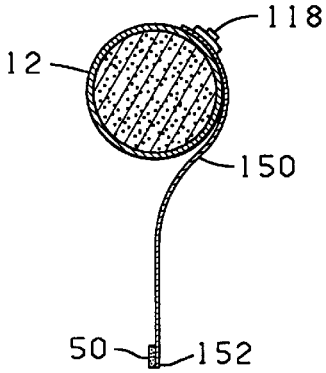
FIG. 3B is a plan view of the pot showing the sheet clamped to the pot.
Figure 4B:
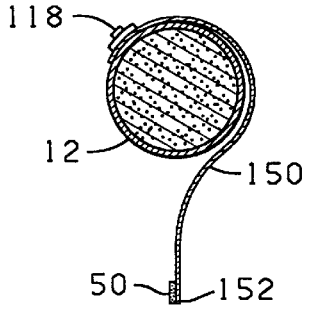
FIG. 4B is a plan view of the sheet and pot of FIG. 3B advanced about 90° counter-clockwise.
Figure 5A:
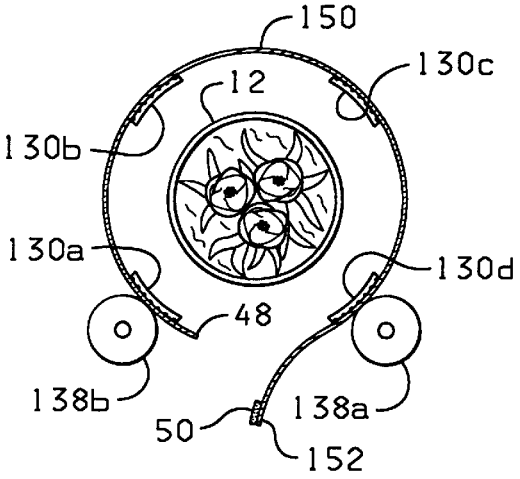
FIG. 5A is a plan view of the sheet and wrapping cage of FIG. 3A advanced about 180° counter-clockwise.

Shown in FIGS. 4A and 4B are the wrapping cage 120 and turntable 114 rotated approximately another 90° whereby wrapper plate 130*c* engages the sheet 150 against the guide roller 138*a*. Shown in FIGS. 5A and 5B, the sheet 150 has again been advanced about 90° to a position where the leading edge 48 is passed adjacent guide roller 138*b*, which is stationary. At this stage, wrapper plate 130*d* is adjacent roller guide 138*a*. As the wrapping cage 120 is rotated approximately another 90° (shown in FIGS. 6A and 6B), the leading edge 48 and the trailing edge 152 engage each other at a position between wrapper plate 130*a* and roller guide 138*a*, whereby the bonding material 50 which is disposed upon a portion of the sheet 50 generally near the trailing edge 152 sealingly connects a portion of the sheet 150 adjacent the trailing edge 152 to a portion of the sheet 150 adjacent the leading edge 48 thereby forming a sealed portion 153 wherein the sheet 50 is formed into a wrapper about the pot 12. At this point, the clamp or dog 118 is released as shown in FIG. 6B. The suction from wrapper plates 130*a*–130*d* can be released and these plates can then be retracted to a retracted position, as explained above, to clear the wrapping cage 120 from the potted plant 12, now wrapped, to facilitate the removal of the wrapped potted plant from the wrapping assembly 110.

It will be appreciated that the shape of the sheet of material 150 which is cut from the unrolled portion 40 is typically trapezoidal because when the item 12 wrapped is a potted plant, pots generally have an inverted frusto-conical shape which is most efficiently and economically wrapped with a trapezoidally shaped sheet.

The trapezoidal shape necessitates that the sheet be preferably cut at an angle "A" to the edges 42 and 44 of the unrolled portion of material 40. As a result, in order to increase the speed and efficiency of the wrapping process, and to reduce waste, the sheet delivery assembly 20 can be rotated on its axis to an inverted position so that the next sheet of material to be delivered to the wrapping assembly 110 will be oriented in a suitable vertical or semi-vertical position for wrapping, that is, having the side with the largest width of the trapezoid-shaped sheet above the side with the lesser width. When the sheet delivery assembly 20 is in this rotated inverted position the gripper assembly 100 is utilized to advance the leading edge 48 to wrapper plate 130*b* and guide roller 138*b*, rather than to wrapper plate 130*a* and guide roller 138*a*. The sheet 150 can then be wrapped about the item 12 in a process which is basically a mirror-image of the wrapping process described in detail above. In this version, the wrapping cage 120 is rotated in a clockwise direction 146*a*. It may be desirable to have a bonding material applicator in a position opposite the bonding material applicator 52 on the other side of the unrolled portion 40 for applying a bonding material thereto.

It will also be appreciated that the sheet of material 150 and the sheet delivery assembly 20 which supports it may be oriented in any vertical or semi-vertical plane, wherein vertical or semi-vertical is defined to include any angle from 0° to 90°. When, for example, the item 12 is an item such as a potted plant wherein the pot has a frusto-conical shape having a sloped side the sheet may be delivered at an angle which is approximately equal to the angle of the side of the pot to the turntable 114. When the sheet delivery assembly 20 is rotated as described above, and after the sheet 150 has been cut from the unrolled portion 40 after the rotation, the sheet delivery assembly 20 is rotated back to its original position in preparation for feeding another sheet 150 to another item 12. After the sheet 150 has been wrapped about the pot 12, the pot 12 and sheet 150 can be removed from the turntable 114, generally following retraction of the wrapper plates 130*a*–130*d* to a retracted position.

Figure 7A:
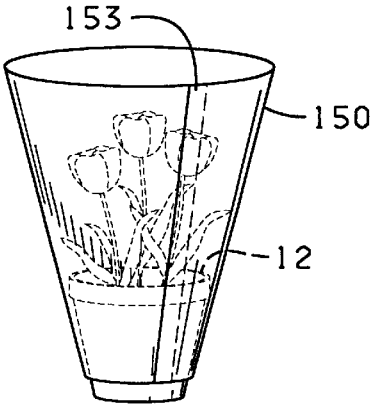
FIG. 7A is a side view of a sheet wrapped about a pot in accordance with the present invention.
Figure 7B:
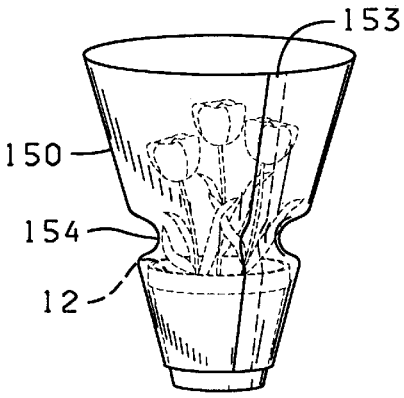
FIG. 7B is a side view of the sheet and pot of FIG. 7A with a portion of the sheet crimped about the upper end of the pot.
Figure 7C:
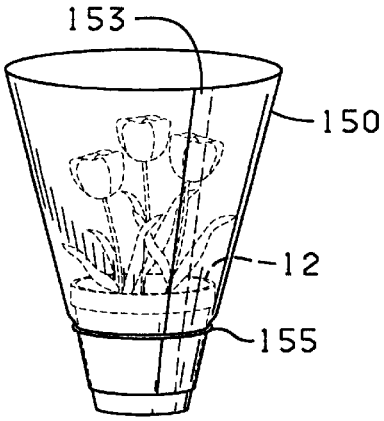
FIG. 7C is a side view of a sheet of material wrapped about a pot and held thereto by a band.

Shown in FIG. 7A is a potted plant 12 having a sheet 150 wrapped thereabout in the method of the present invention. The sheet 150 may be connected to the outer surface of the pot 12 by a bonding material disposed on the sheet 150, the pot 12, or both. Alternatively, the sheet 150 may simply be held about the pot 12 by friction or by crimping a portion 154 of the sheet 150 about the upper end of the pot 12 as shown in FIG. 7B or a band 155 may be placed about the sheet 150 to hold the sheet 150 adjacent the pot 12 as shown in FIG. 7C.

Figure 8A:
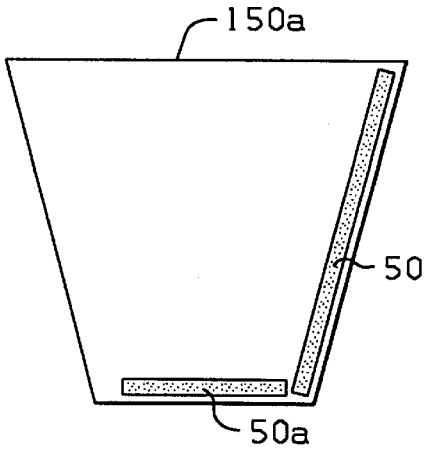
FIG. 8A is a side view of a sheet of material for wrapping a pot in accordance with the present invention.
Figure 8B:
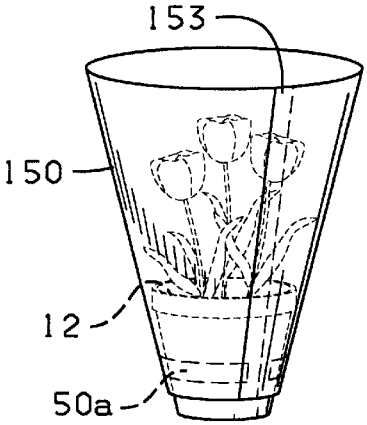
FIG. 8B is a perspective view of a pot wrapped with the sheet of FIG. 8A.

It will be appreciated by one of ordinary skill in the art that although the bonding material 50 has been shown in the description above as being disposed in a position along the trailing edge of the sheet 150, bonding material may be disposed in other positions upon the sheet of material. For example, shown in FIG. 8A is a sheet of material 150*a* which has a bonding material 50*a* disposed along the lower edge thereof. When this sheet of material 150*a* is wrapped about a pot 12, the bonding material 50*a* engages the lower end of the outer surface of the pot 12 and bondingly connects the lower end of the sheet 150*a* to the pot 12 as is shown in FIG. 8B.

Figure 9:
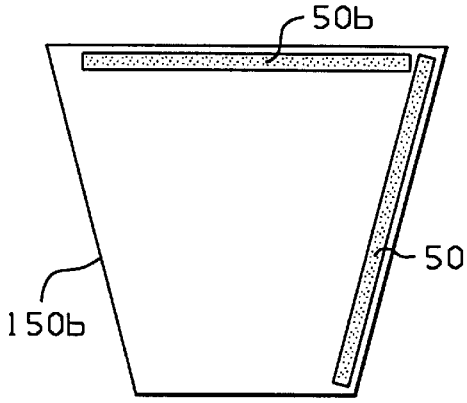
FIG. 9 is a side view of another version of a sheet which may be used with the present invention.

In an alternate embodiment of the sheet, shown in FIG. 9, a sheet 150*b* may have an additional area of bonding material 50*b* which is disposed along the upper edge of the sheet 150*b* for enabling closure of the upper end of the sheet 150*b* after it has been wrapped about the pot 12. The sheet 150*b* may also have the bonding material 50*a* disposed thereon in a way exactly the same as sheet 150*a*.

Figure 10:
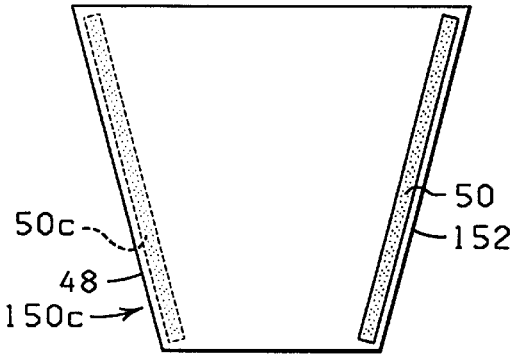
FIG. 10 is a side view of another version of a sheet which may be used with the present invention.

Shown in FIG. 10 is a sheet of material 150*c* which has a bonding material 50*c* disposed on the surface of the sheet opposite the surface having bonding material 50 thereon and on the side opposite the side having the bonding material 50. When the sheet 150*c* is wrapped about the pot 12 and the leading edge 48 engages the trailing edge 152, the bonding material 50 will engage the bonding material 50*c*. Preferably on sheet 150*c*, both areas of bonding material 50 and 50*c* are cohesive materials. The sheet 150*c* may also have either or both of the areas of bonding material 50*a* or 50*b*.

Figure 11:
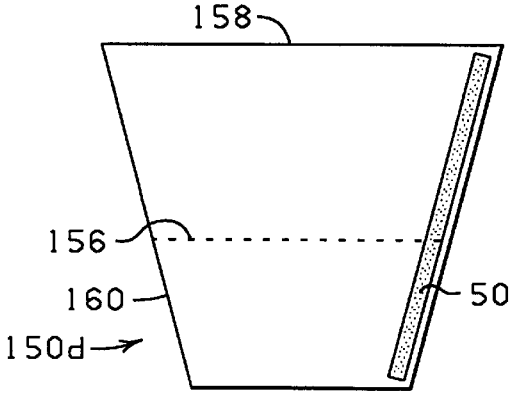
FIG. 11 is a side view of another version of a sheet which may be used with the present invention.
Figure 12A:
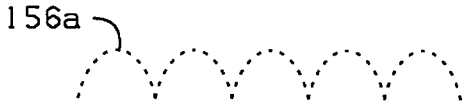
FIG. 12A–12F are versions of perforation patterns which may be used in place of the perforation pattern shown in FIG. 11.
Figure 12B:
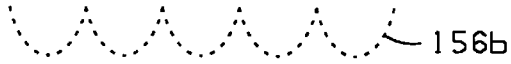
Figure 12C:
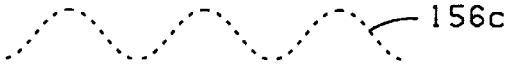
Figure 12D:
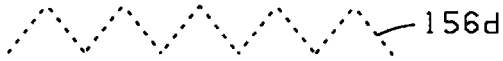
Figure 12E:
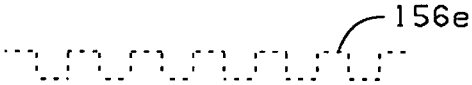
Figure 12F:
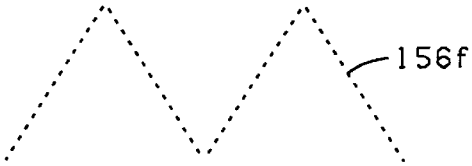

Shown in FIG. 11 is another version of the present invention which is exactly the same as the other sheets shown herein except that a sheet of material 150*d* has perforations 156 such that after the sheet of material 150*d* has been wrapped about the pot 12, an upper portion 158 of the sheet 150*d* can be detached, leaving a lower portion 160 still disposed about the pot 12 as a decorative cover. The perforations 156 can be provided in any number of patterns upon the sheet 150*d*. Examples of such patterns are scalloped perforations 156*a* shown in FIG. 12A, inverted scalloped perforations 156*b* shown in FIG. 12B, sine-wave type perforations 156*c* shown in FIG. 12*c*, toothed or zig-zag perforations 156*d* shown in FIG. 12D, rectangular perforations 156*e* shown in FIG. 12E, or over-sized "petal-type" perforations 156*f* shown in FIG. 12F. Each of these patterns results, upon detachment of the upper portion 158, in the resulting upper edge of the lower portion 160 having a decorative effect or "skirt".

Embodiments of FIGS. 13–18

Figure 13:
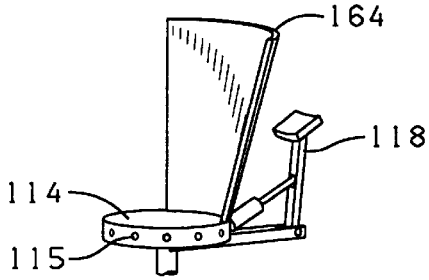
FIG. 13 is a perspective view of a rotatable mold assembly.
Figure 14:
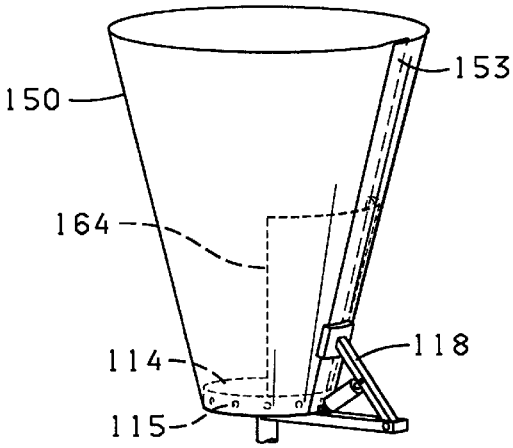
FIG. 14 is a perspective view of the rotatable mold assembly of FIG. 13 used to form a wrapper.
Figure 15A:
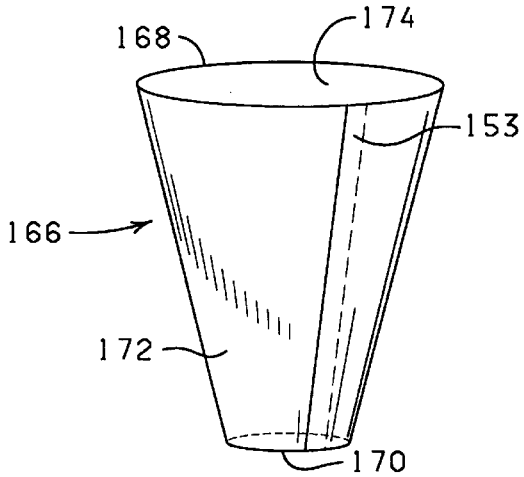
FIG. 15A is a perspective view of the wrapper shown being formed in FIG. 14A.
Figure 15B:
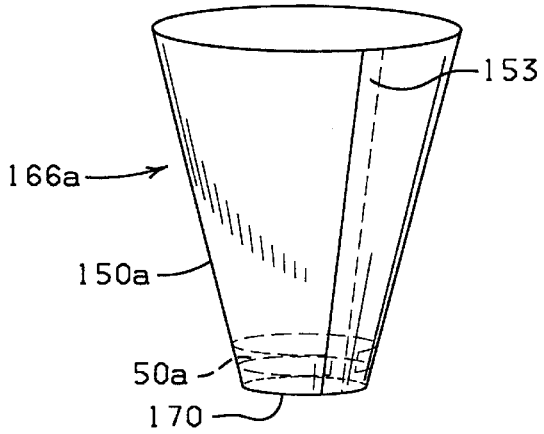
FIG. 15B is a perspective view of another wrapper formed as in FIG. 14.
Figure 19:
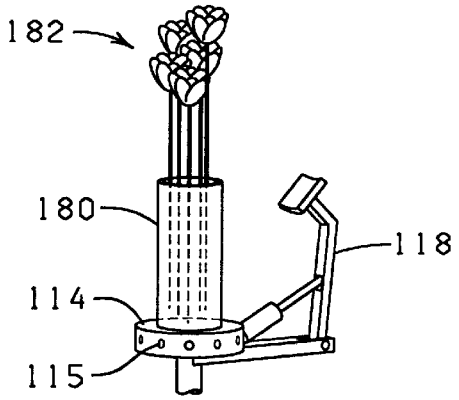
FIG. 19 is a perspective view of a turntable assembly for use in wrapping floral groupings.

In an alternative version of the invention, the apparatus 10 may be used to form a wrapper, cover or sleeve which is independent of a pot or other item. In this version, the apparatus and method are the same as described above for FIGS. 1–12F except that the wrapping assembly 110 comprises a mold assembly such as shown in FIG. 19 as comprising a turntable 114 and a mold 164 against which the sheet 150 can be formed. The mold 164 is shown in FIG. 13 as a curved plate which extends about only a portion of the circumference of the turntable 114, but it will be understood that the mold 164 may have any shape as long as the cover formed thereabout is removable from the mold 164 and turntable 114. The sheet of material 150 is delivered to the mold 164 and turntable 114 in a vertical or semi-vertical orientation and at least a portion of the sheet 150 is held about the turntable 114 by the suction effected through the holes 115 in the turntable 114 and by the clamp 118 which presses a portion of the sheet 150 against the outer surface of the mold 164 as shown in FIG. 14. After the sheet 150 has been formed about the mold 164 and portions of the sheet 150 are overlapped to form a seal 153, the formed sheet, now a wrapper (or cover or sleeve) 166 as shown in FIG. 15A, can be removed from the mold 164 and turntable 114. The wrapper 166 has an upper end 168, a lower end 170, an outer surface 172, and an inner surface 174. The wrapper 166 thus formed may be used to wrap potted plants or floral groupings or any other item about which the wrapper may be effectively wrapped. Any of the sheets described herein may be used. FIG. 15B, for example, shows a wrapper 166*a* formed from sheet 150*a* which has a bonding material 50*a* disposed on the inner surface thereof near the lower end 170 thereof.

Figure 16:
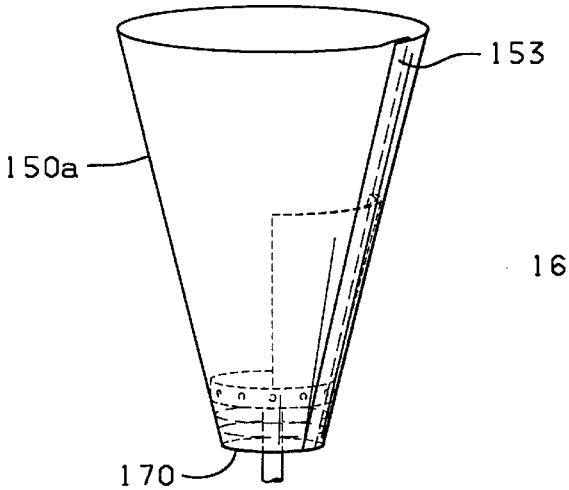
FIG. 16 is a perspective view of a wrapper formed about a mold assembly in another manner in accordance with the present invention.
Figure 17:
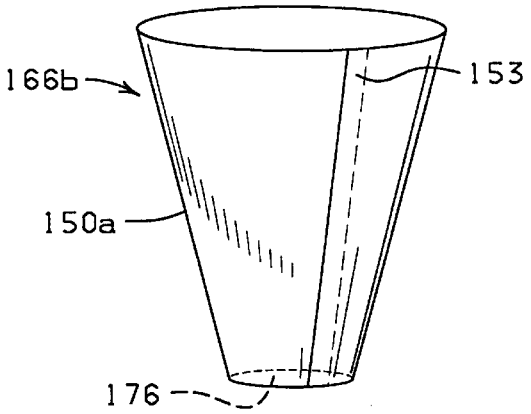
FIG. 17 is a perspective view of a wrapper formed to have a closed bottom.
Figure 18:
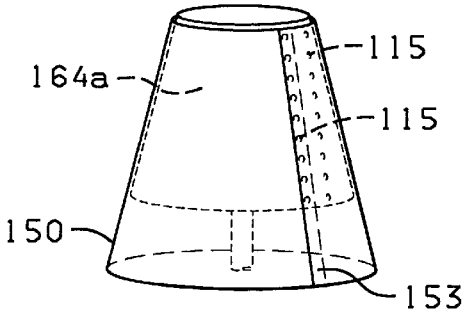
FIG. 18 is a perspective view of another version of a mold assembly for forming a cover.

In an alternative method of forming an independent cover, a sheet of material such as the sheet 150*a* is disposed about the turntable 114 and mold 164 (or the turntable 114 alone) wherein the lower end 170 of the sheet 150*a* extends a distance below the turntable 114 as shown in FIG. 16. Before or after removal of the cover thus formed from the turntable, the lower end 170 of the wrapper can be closed to form a wrapper 166*b* having a closed bottom 176 such as shown in FIG. 17, the closure of the bottom being effected by the tucking or folding under of portions of the lower end 170 of the sheet 150*a* wherein the bonding material 50*a* bondingly connects portions of the sheet together. Shown in FIG. 18 is a mold 164*a* which is another version of the invention. The mold 164*a* has a frusto-conical shape about which the sheet 150 can be formed being held thereto by a suction exerted through holes 115 in the mold 164*a*.

Embodiments of FIGS. 19–24

Figure 20:
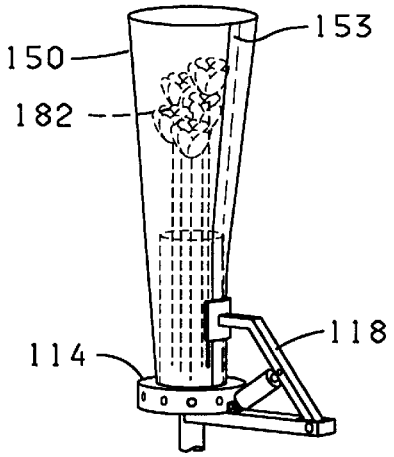
FIG. 20 is a perspective view of a wrapper being formed about a floral grouping using the turntable assembly of FIG. 19.
Figure 21:
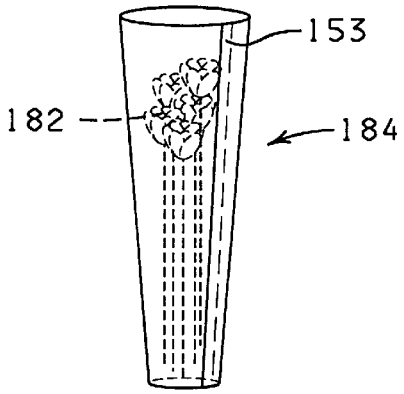
FIG. 21 is a perspective view of a floral grouping wrapped by the method shown in FIG. 20.
Figure 22:
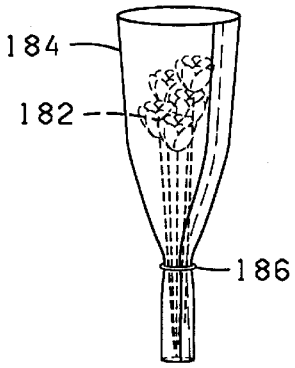
FIG. 22 is a perspective view of a sheet wrapped about a floral grouping in accordance with the present invention and held thereabout by a band.
Figure 23:
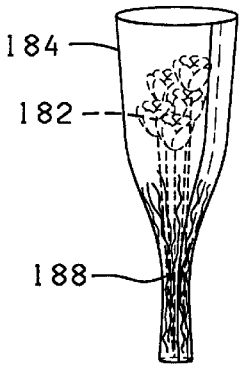
FIG. 23 is a perspective view of a sheet wrapped about a floral grouping in accordance with the present invention and held thereabout by a crimped portion.

In yet another version of the invention, the apparatus 20 can be used to form a wrapper about a floral grouping. In this case, the turntable 114 is modified to have a holding device 180 for holding a floral grouping 182 in a position, such as the vertical position shown in FIG. 19 whereby the sheet delivered by the apparatus 20 as previously described can be formed as a wrapper about the floral grouping 182. The holding device 180 is shown as an open cylinder attached at its base to the turntable 114, but it will be understood that the holding device 180 can be any device or container which holds the floral grouping 182 in any manner appropriate to the present invention. In the method of the invention, the floral grouping 182 is disposed in the holding device 180 and a sheet of material is advanced and wrapped in the manner described above to form a wrapper 184 about the floral grouping 182 as shown in FIGS. 20 and 21. The wrapper 184 may be additionally held about the floral grouping 182 by placing a tie or band 186 or other banding device about the wrapper 184 as shown in FIG. 22 or in any other manner known in the art. Alternatively, the wrapper 184 may be held about the floral grouping 182 by forming a crimped area 188 in a portion of the wrapper 184 as shown in FIG. 23.

The wrapper 184 may additionally be formed with a closed bottom as described above wherein the closure is effected, for example, simply by pinching the lower end of the wrapper 184 and causing adjacent portions of the wrapper 184 having a bonding material thereon to be bonded together. The upper end of the wrapper 184 may be closed in a similar manner. Any sheet of material described herein, or any sheet of material which functions in accordance with the present invention, may be used to form the wrapper 184 about the floral grouping 182.

Figure 24:
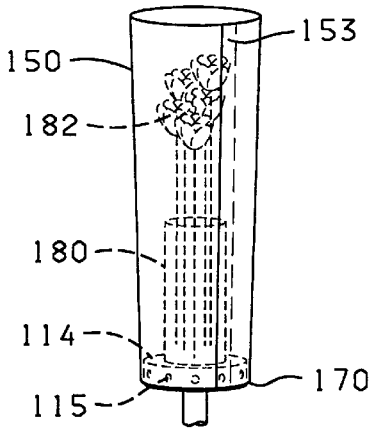
FIG. 24 is a perspective view of another method for forming a wrapper about a floral grouping.

Finally, shown in FIG. 24 is another manner of forming a sheet 150 about a floral grouping 182 disposed in the holding device 180 wherein the lower end 170 of the sheet 150 is held about the floral grouping 182 by being held to the outer edge of the turntable 114 by a suction force exerted through the holes 115. In this version the clamp or dog 118 is not necessary for the holding of the sheet 150 in a position about the turntable 114 for forming the wrapper 184.

Changes may be made in the construction and the operation of the various components, elements and assemblies described herein or in the steps or the sequence of steps of the methods described herein without departing from the spirit and scope of the invention as defined in the following claims.

What is claimed is:

1. A method of wrapping a sheet of material about a potted plant, the potted plant having an outer peripheral surface and a bottom surface and the sheet having a leading edge, a lower edge and an upper edge, the method comprising the steps of:

disposing the potted plant upon a rotatable support means; and rotating the rotatable support means and the potted plant and drawing the sheet of material about outer peripheral surface of the potted plant until the leading edge of the sheet engages another portion of the sheet of material and is bonded thereto via a bonding material thereby connecting the leading edge to the other portion of the sheet wherein the sheet of material circumferentially encompasses at least a portion of the outer peripheral surface of the pot.

2. The method of claim 1 wherein the sheet of material is provided by severing a portion of a roll of material to form the sheet of material.

3. The method of claim 1 wherein in the step of drawing the sheet, the sheet further comprises a pot bonding material thereon and when the sheet is drawn about the outer surface of the potted plant, the pot bonding material engages the outer surface of the potted plant and bondingly connects a portion of the sheet to the potted plant.

4. The method of claim 1 wherein the step of rotating the rotatable support means is preceded by applying the bonding material to a portion of the sheet of material.

5. The method of claim 1 wherein the sheet of material is engaged by holding means for holding the portion of the sheet of material in a position adjacent the potted plant.

6. The method of claim 5 wherein the holding means further comprises means for clamping a portion of the sheet of material against the outer peripheral surface of the potted plant or against the support means.

7. The method of claim 5 wherein the holding means further comprises means in the rotatable support means for exerting a suction force upon a portion of the sheet.

8. The method of claim 1 wherein in the rotating step, a portion of the sheet of material is positioned to extend a distance above the potted plant.

9. The method of claim 1 further comprising the step of sealing together the upper edge of the sheet of material for closing the sheet of material about the potted plant.

10. The method of claim 1 wherein after the sheet is wrapped about the potted plant, a band is applied to hold the sheet about the potted plant.

11. A method of wrapping a sheet of material about a potted plant having an outer peripheral surface and a bottom surface and the sheet having a leading edge, a lower edge and an upper edge, the method comprising the steps of:

disposing the potted plant upon a rotatable support means; and automatically drawing the sheet of material about the outer peripheral surface of the potted plant until the leading edge of the sheet engages another portion of the sheet of material and is bonded thereto via a bonding material thereby connecting the leading edge to the other portion of the sheet wherein the sheet of material circumferentially encompasses at least a portion of the outer peripheral surface of the potted plant.

12. The method of claim 11 wherein the sheet of material is provided by severing a portion of a roll of material to form the sheet of material.

13. The method of claim 11 wherein in the step of automatically drawing the sheet, the sheet further comprises a pot bonding material thereon and when the sheet is drawn about the potted plant, the pot bonding material engages the outer surface of the potted plant and bondingly connects a portion of the sheet to the potted plant.

14. The method of claim 11 wherein the step of rotating the rotatable support means is preceded by applying the bonding material to a portion of the sheet of material.

15. The method of claim 11 further comprising the step of sealing together the upper edge of the sheet of material for closing the sheet of material about the potted plant.

16. The method of claim 11 wherein after the sheet is wrapped about the potted plant, a band is applied to hold the sheet about the potted plant.

* * * * *

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

It is certified that error appears in the above-identified patent and that said Letters Patent is hereby corrected as shown below:

Drawings,

Fig. 1, please delete the numeral "130d" and substitute -- 130b -- therefor; please delete the numeral "132d" and substitute -- 132b -- therefor; and please delete the numeral "140d" and substitute -- 140b -- therefor.

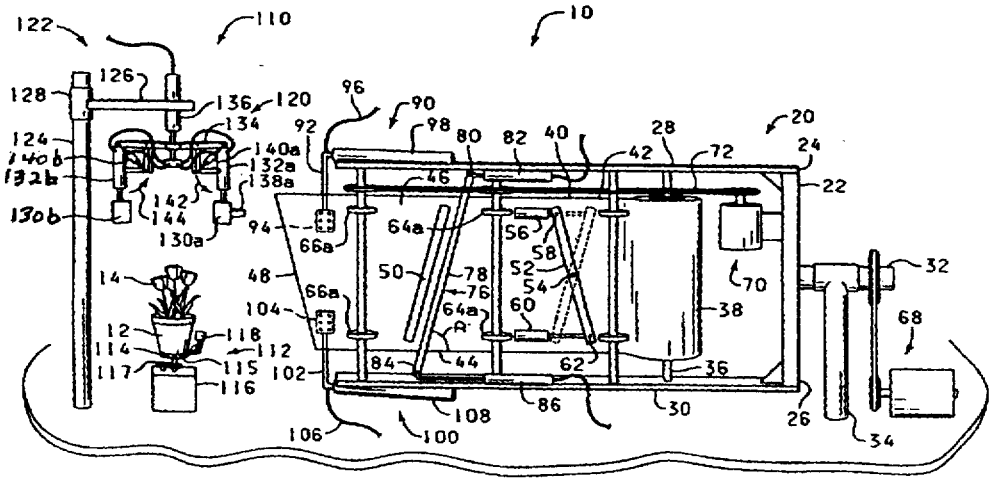

FIG. 1

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

Figure 2A:
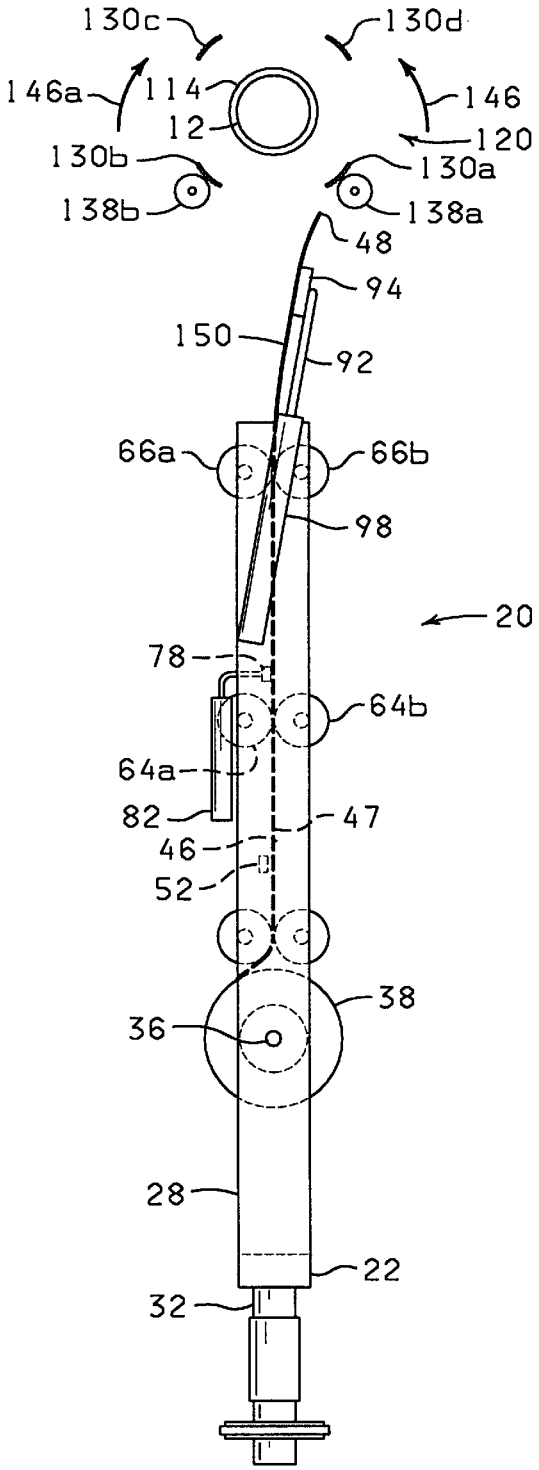
FIG. 2A is a plan view of the apparatus of FIG. 1.

It is certified that error appears in the above-identified patent and that said Letters Patent is hereby corrected as shown below:

Fig. 2A, please delete the numerals -- 40 -- and -- 152 -- and each associated lead line, as shown .

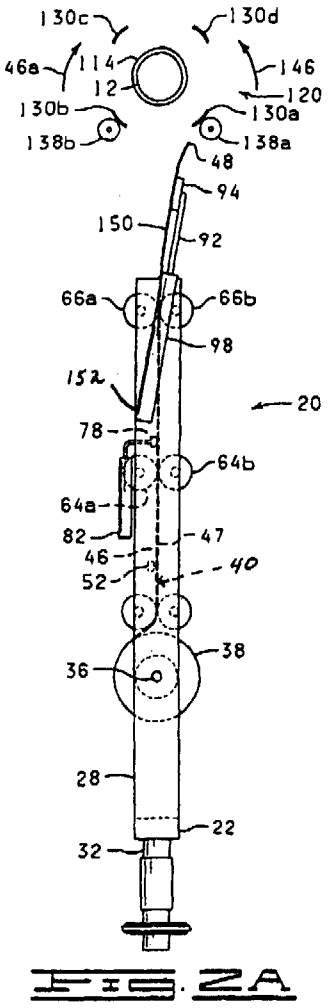

FIG. 2A

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

Figure 6A:
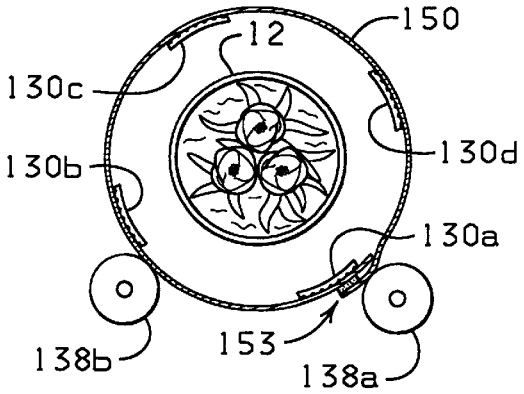
FIG. 6A is a plan view of the sheet and wrapping cage of FIG. 3A advanced about 270° counter-clockwise.
Figure 5B:
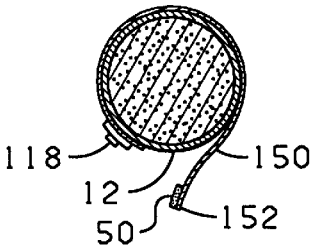
FIG. 5B is a plan view of the sheet and pot of FIG. 3B advanced about 180° counter-clockwise.
Figure 6B:
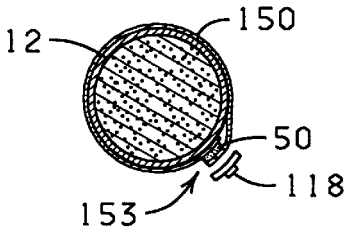
FIG. 6B is a plan view of the sheet and pot of FIG. 3B advanced about 270° counter-clockwise.

It is certified that error appears in the above-identified patent and that said Letters Patent is hereby corrected as shown below:

Fig. 6A, please add the numerals -- 48 -- and -- 152 -- and each associated lead line, as shown .

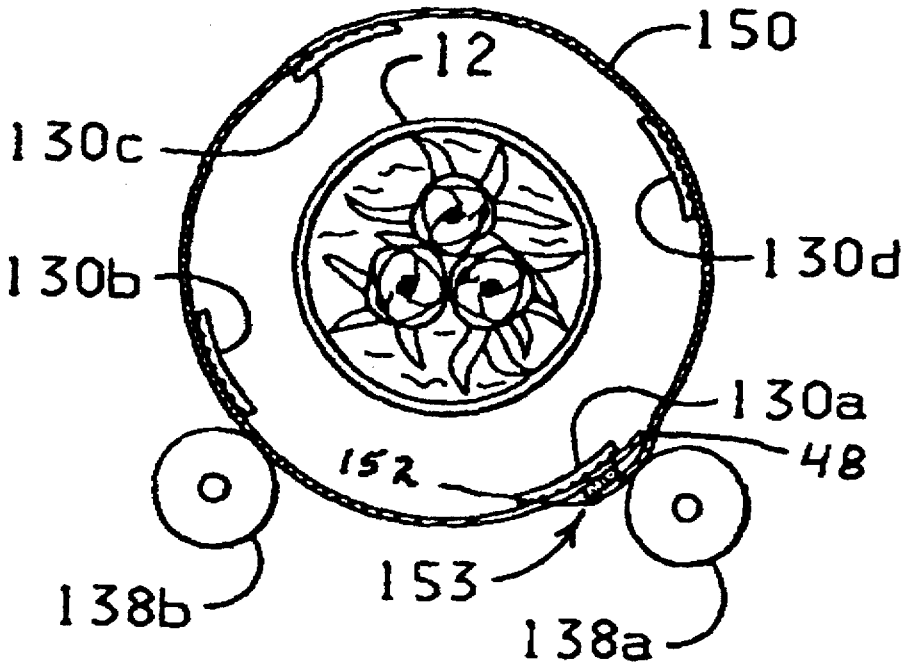

FIG. 6A

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

It is certified that error appears in the above-identified patent and that said Letters Patent is hereby corrected as shown below:

Fig. 8B, please insert the numeral -- 50 -- and its associated lead line.

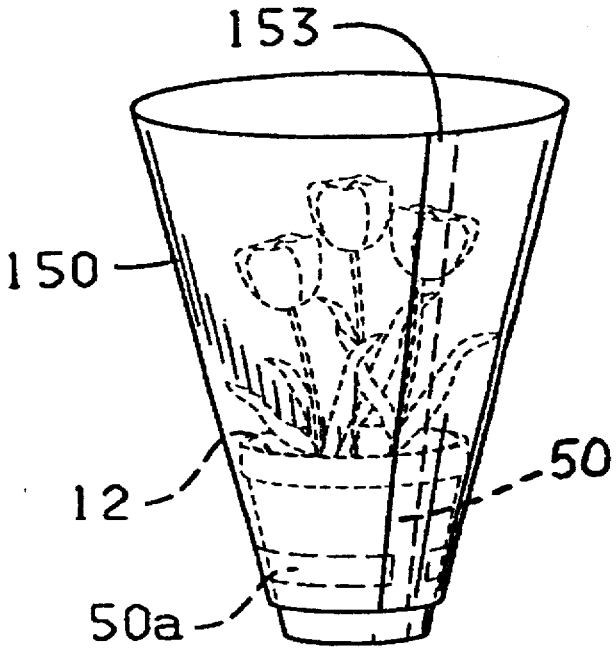

FIG. 8B

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

It is certified that error appears in the above-identified patent and that said Letters Patent is hereby corrected as shown below:

Fig. 16, please add the numerals -- 50a --, -- 114 -- and -- 164 -- and each associated lead line, as shown.

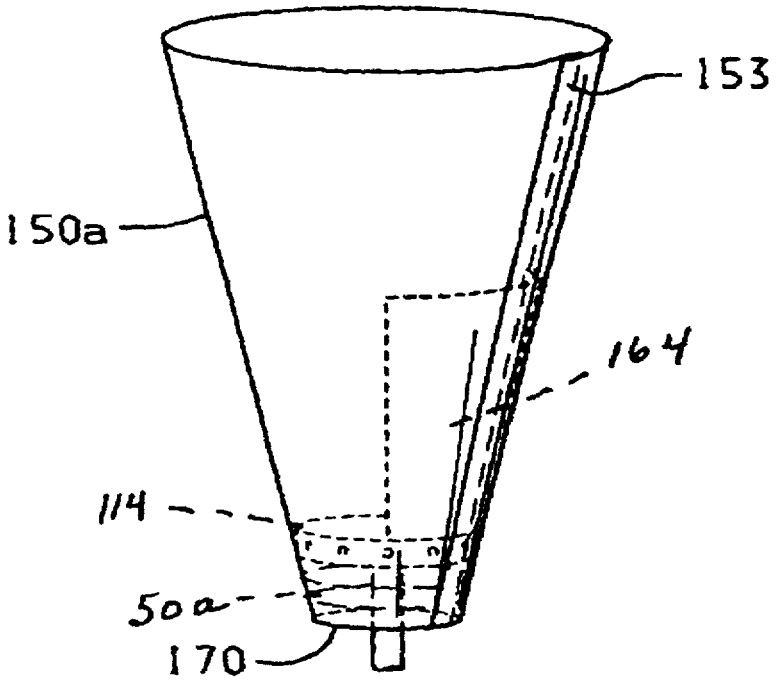

FIG. 16

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

It is certified that error appears in the above-identified patent and that said Letters Patent is hereby corrected as shown below:

Fig. 20, please add the numerals -- 180 -- and -- 184 -- and each associated lead line, as shown.

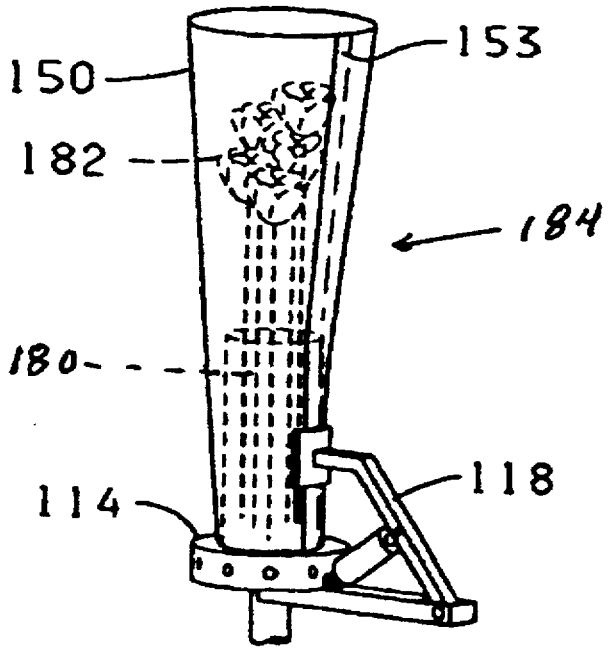

FIG. 20

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

It is certified that error appears in the above-identified patent and that said Letters Patent is hereby corrected as shown below:

Column 1,
Line 8, delete "Methods"." and substitute -- Method". -- therefor;
Line 21, after "a" and before "plan" insert -- top --;
Line 22, after "a" and before "plan" insert -- top --;
Line 24, after "a" and before "plan" insert -- top --;
Line 26, after "a" and before "plan" insert -- bottom --;
Line 28, after "a" and before "plan" insert -- top --;
Line 30, after "a" and before "plan" insert -- bottom --;
Line 32, after "a" and before "plan" insert -- top --;
Line 34, after "a" and before "plan" insert -- bottom --;
Line 36, after "a" and before "plan" insert -- top --;
Line 38, after "a" and before "plan" insert -- bottom --;
Line 40, delete "side" and substitute -- perspective -- therefor;
Line 42, delete "side" and substitute -- perspective -- therefor;
Line 44, delete "side" and substitute -- perspective -- therefor;

Column 4,
Line 42, delete "means";

Column 5,
Line 3, delete "or";
Line 38, after "pot" and before "and" insert -- 12 --;
Line 50, after "Easter grass," and before "stuffed" insert -- or --;

Column 6,
Line 13, after "47" and before "and" insert -- (FIG. 2) --;
Line 19, after "surface" and before "of' insert -- 46 or 47 --;
Line 25, delete "of wrapping material 38" and substitute therefor -- 38 of wrapping material --;
Line 30, delete "side" and substitute -- surface 46 or 47 -- therefor;
Line 3 8, delete "of wrapping material 38. " and substitute therefor -- 38 of wrapping material. --;

Column 8,
Line 42, delete "mud/or" and substitute -- and/or -- therefor;

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

Figure 2B:
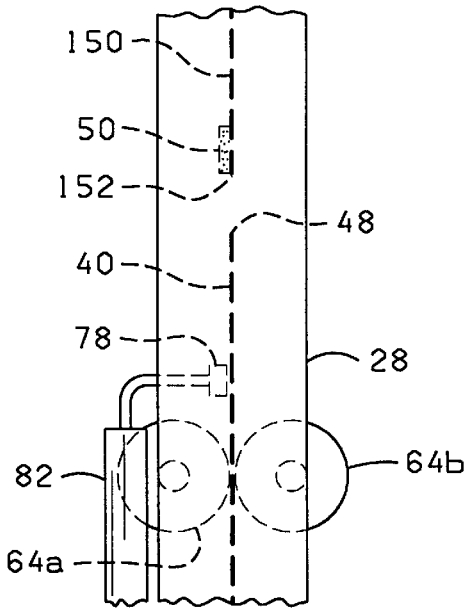
FIG. 2B is a plan view of an enlargement of the unrolled portion of the roll of material after the cutting step.
Figure 3A:
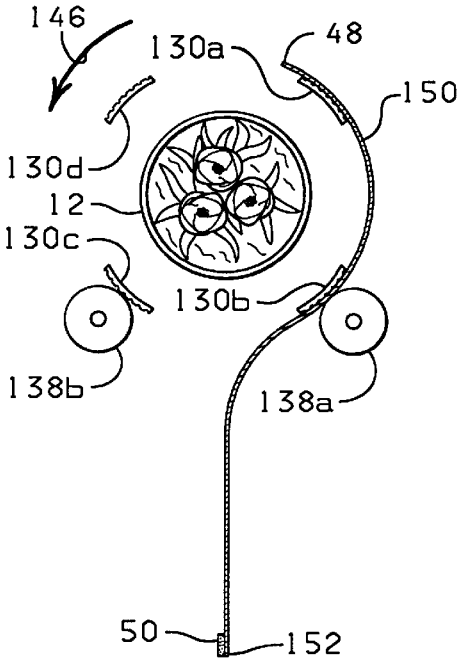
FIG. 3A is a plan view of a sheet of material partially wrapped about a pot by a wrapping cage.

It is certified that error appears in the above-identified patent and that said Letters Patent is hereby corrected as shown below:

Column 9,
Line 23, after "material" and before "to" insert -- 50 --;
Line 28, after "material" and before "may" insert -- 50 --;
Line 31, after "material" and before "is" insert ---- 50 --;
Line 37, after "material" and before "to" insert -- 50 --;
Line 38, after "material" and before "was" insert -- 50 --;
Line 62, after "rollers" and before "via" insert -- **64*a*, 64*b*, 66*a* and 66*b*** --;

Column 10,
Line 15, after "the" and before "plate" insert -- gripper --;
Lne 19, delete "comprises" and substitute -- comprising -- therefor;
Line 21, delete "bar" and substitute -- support -- therefor;
Line 23, after "apparatus" insert -- 10 --;
Line 28, delete "member" and substitute -- support -- therefor;
Line 29, delete "member";
Line 38, delete "member";
Line 39, delete "member";
Line 49, delete "wheels" and substitute -- wheel -- therefor;

Column 11,
Line 11, delete "pot." and substitute -- pot 12. -- therefor;
Line 16, after "plate" and before "attached" insert -- **130*a*-130*d*** --;
Line 19, delete "FIG. 2" and substitute therefor -- FIGS. 3A and 4A --;
Line 19, delete "plate)." and substitute -- wrapper plates **130*a*-130*d***). -- therefor;
Line 20, delete "plate is" and substitute -- wrapper plates **130*a*-130*d*** are -- therefor;
Line 21, delete "cylinders 132" and substitute -- cylinders **132*a-d*** -- therefor;
Line 28, delete "plate." and substitute --plate **130*a* or 130*b***.-- therefor;
Line 40, delete "**140*d*" and substitute -- 140*b*** -- therefor;
Line 41, delete "**130*d*" and substitute -- 130*b*** -- therefor;
Line 43, delete "**130*d*" and substitute -- 130*b*** -- therefor;
Line 66, delete "FIG. 2 is a diagrammatic plan view" and substitute therefor -- FIGS. 2A and 2B are top plan views -- therefor;

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

It is certified that error appears in the above-identified patent and that said Letters Patent is hereby corrected as shown below:

Column 12,
Line 1, after "roll" and before "of" insert -- 38 --;
Line 2, delete "38";
Line 21, delete "lower" and substitute -- second -- therefor;
Line 23, after "dog" and before "or" insert -- 118 --;
Line 25, delete "lower" and substitute -- second -- therefor;
Line 28, delete "lower" and substitute -- second -- therefor;
Line 32, delete "which";
Line 34, after "roll" and before "of" insert -- 38 --;
Line 44, delete "side" and substitute -- edge -- therefor;
Line 45, delete "side" and substitute -- edge -- therefor;
Line 54, delete "**146*a*." and substitute -- 146*a* (FIG. 2A**). -- therefor;
Line 64, after "sheet" and before "may" insert -- 150 --;
Line 66, after "pot" and before "to" insert -- 12 --;

Column 14,
Line 38, after "sheet" insert -- **150*c*** --;

Column 15,
Line 4, delete "FIG. 19" and substitute -- FIG. 13 -- therefor;
Line 30, delete "cover," and substitute -- wrapper, -- therefor;
Line 35, delete "cover" and substitute -- wrapper -- therefor;
Line 35, delete "turntable," and substitute therefor -- turntable 114, --;
Line 3 8, delete "bottom" and substitute -- lower end 170 -- therefor;
Line 49, delete "grouping." and substitute therefor -- grouping 182. --;
Line 61, after "material" and before "is" insert -- 150 --;

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

It is certified that error appears in the above-identified patent and that said Letters Patent is hereby corrected as shown below:

Column 16,
Line 19, delete "the holding of" and substitute -- holding -- therefor;
Line 36, after "about" and before "outer" insert -- the --; and
Line 43, delete "pot." and substitute therefor -- potted plant. -- therefor.

Signed and Sealed this

Twenty-fifth Day of December, 2001

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 5,813,198 
DATED : September 29, 1998
INVENTOR(S) : Donald E. Weder et al.

It is certified that error appears in the above-identified patent and that said Letters Patent is hereby corrected as shown below:

Drawings,

Fig. 1, please delete the numeral "130d" and substitute -- 130b -- therefor; please delete the number "132d" and substitute -- 132b -- therefor; and please delete the numeral "140d" and substitute -- 140b -- therefor.

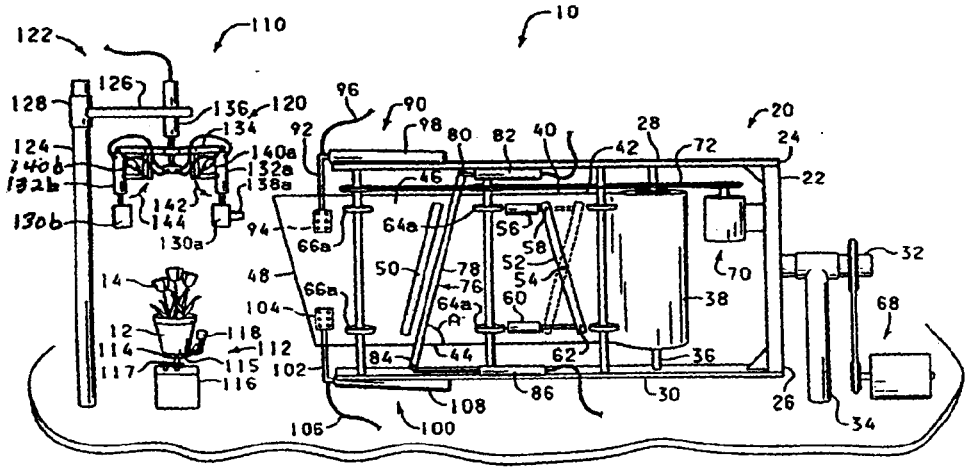

FIG. 1

UNITED STATES PATENT AND TRADEMARK OFFICE

CERTIFICATE OF CORRECTION

PATENT NO. : 5,813,198 
DATED : September 29, 1998
INVENTOR(S) : Donald E. Weder et al.

It is certified that error appears in the above-identified patent and that said Letters Patent is hereby corrected as shown below:

Fig. 2A, please delete the numerals -- 40 -- and -- 152 -- and each associated lead line, as shown.

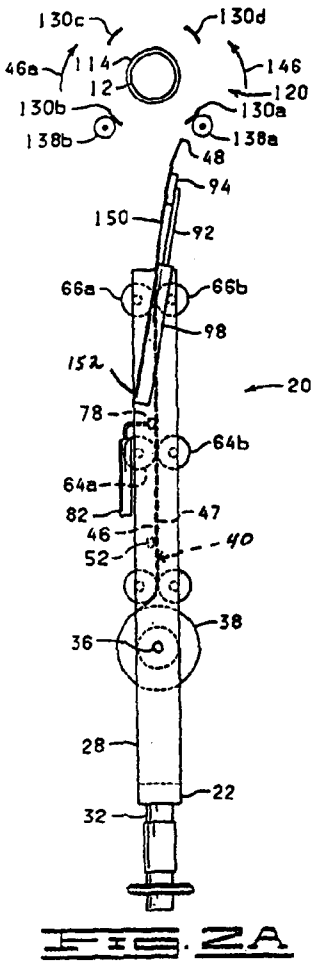

FIG. 2A

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

It is certified that error appears in the above-identified patent and that said Letters Patent is hereby corrected as shown below:

Fig. 6A, please add the numerals -- 48 -- and -- 152 -- and each associated lead line, as shown.

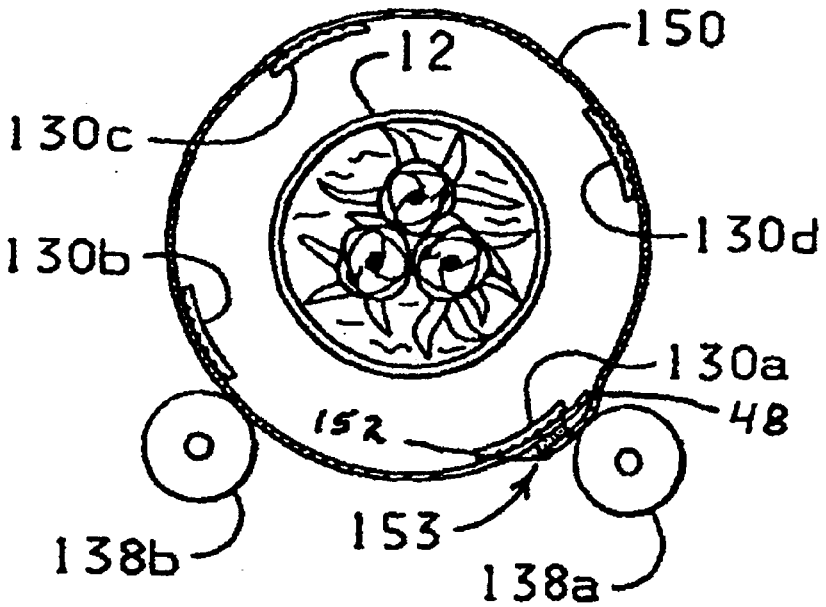

FIG. 6A

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

It is certified that error appears in the above-identified patent and that said Letters Patent is hereby corrected as shown below:

Fig. 8B, please delete the numeral -- 50 -- and its associated lead line.

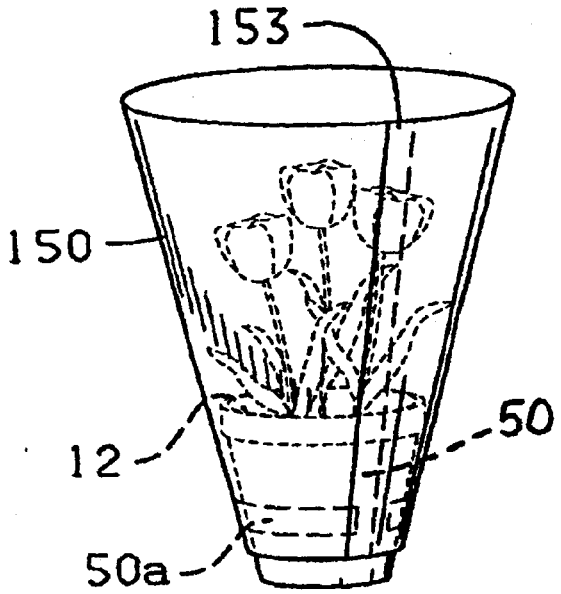

FIG. 8B

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

It is certified that error appears in the above-identified patent and that said Letters Patent is hereby corrected as shown below:

Fig. 16, please delete the numerals -- 50a --, -- 114 -- and -- 164 -- and each associated lead line, as shown.

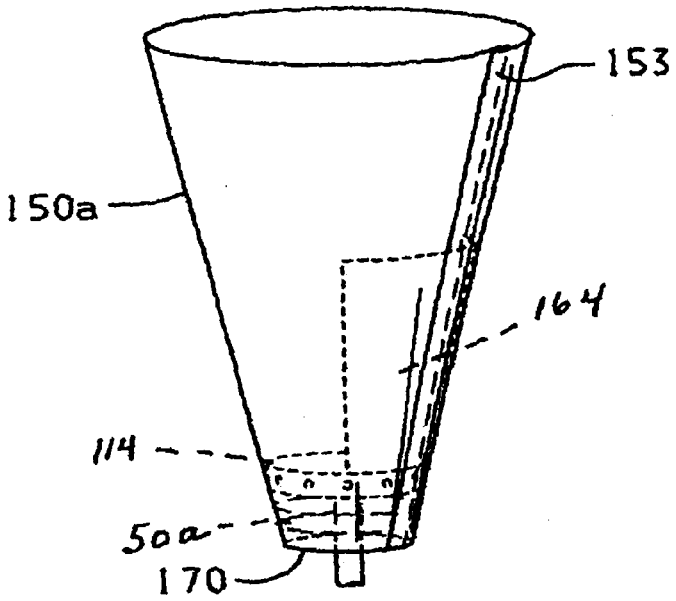

FIG. 16

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

It is certified that error appears in the above-identified patent and that said Letters Patent is hereby corrected as shown below:

Fig. 20, please delete the numerals -- 180 -- and -- 184 -- and each associated lead line, as shown.

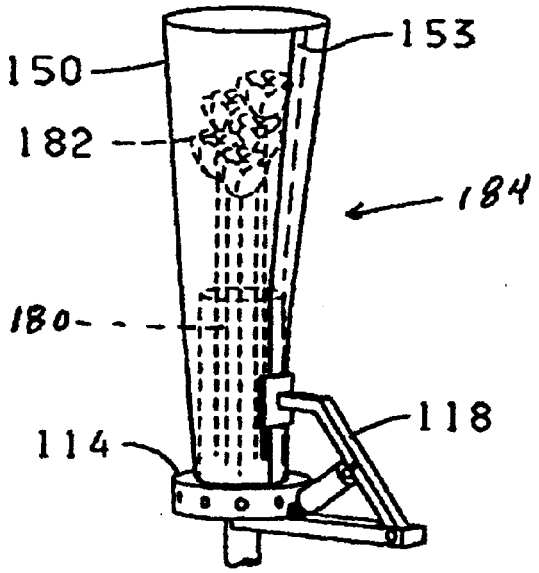

FIG. 20

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

It is certified that error appears in the above-identified patent and that said Letters Patent is hereby corrected as shown below:

Column 1,
Line 8, delete "Methods"." and substitute -- Method". -- therefor;
Line 21, after "a" and before "plan" insert -- top --;
Line 22, after "a" and before "plan" insert -- top --;
Line 24, after "a" and before "plan" insert -- top --;
Line 26, after "a" and before "plan" insert -- bottom --;
Line 28, after "a" and before "plan" insert -- top --;
Line 30, after "a" and before "plan" insert -- bottom --;
Line 32, after "a" and before "plan" insert -- top --;
Line 34, after "a" and before "plan" insert -- bottom --;
Line 36, after "a" and before "plan" insert -- top --;
Line 38, after "a" and before "plan" insert -- bottom --;
Line 40, delete "side" and substitute -- perspective -- therefor;
Line 42, delete "side" and substitute -- perspective -- therefor;
Line 44, delete "side" and substitute -- perspective -- therefor;

Column 4,
Line 42, delete "means" (first occurrence);

Column 5,
Line 3, delete "or";
Line 38, after "pot" and before "and" insert -- 12 --;
Line 50, after "Easter grass," and before "stuffed" insert -- or --;

Column 6,
Line 13, after "47" and before "and" insert -- (FIG. 2) --;
Line 19, after "surface" and before "of" insert -- 46 or 47 --;
Line 25, delete "of wrapping material 38" and substitute therefor -- 38 of wrapping material --;
Line 30, delete "side" and substitute -- surface 46 or 47 -- therefor;
Line 38, delete "of wrapping material 38. " and substitute therefor -- 38 of wrapping material. --;

Column 8,
Line 42, delete "mud/or" and substitute -- and/or -- therefor;

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

It is certified that error appears in the above-identified patent and that said Letters Patent is hereby corrected as shown below:

Column 9,
Line 23, after "material" and before "to" insert -- 50 --;
Line 28, after "material" and before "may" insert -- 50 --;
Line 31, after "material" and before "is" insert -- 50 --;
Line 37, after "material" and before "to" insert -- 50 --;
Line 38, after "material" and before "was" insert -- 50 --;
Line 62, after "rollers" and before "via" insert -- **64*a*, 64*b*, 66*a* and 66*b*** --;

Column 10,
Line 15, after "the" and before "plate" insert -- gripper --;
Line 19, delete "comprises" and substitute -- comprising -- therefor;
Line 21, delete "bar" and substitute -- support -- therefor;
Line 23, after "apparatus" insert -- 10 --;
Line 28, delete "member" and substitute -- support -- therefor;
Line 29, delete "member";
Line 38, delete "member";
Line 39, delete "member";
Line 49, delete "wheels" and substitute -- wheel -- therefor;

Column 11,
Line 11, delete "pot." and substitute -- pot 12. -- therefor;
Line 16, after "plate" and before "attached" insert -- **130*a*-130*d*** --;
Line 19, delete "FIG. 2″ and substitute therefor -- FIGS. 3A and 4A --;
Line 19, delete "plate)." and substitute -- wrapper plates **130*a*-130*d***). -- therefor;
Line 20, delete "plate is" and substitute -- wrapper plates **130*a*-130*d*** are --therefor;
Line 21, delete "cylinders 132" and substitute -- cylinders **132*a-d*** -- therefor;
Line 28, delete "plate." and substitute -- plate **130*a* or 130*b***. -- therefor;
Line 40, delete "**140*d*" and substitute -- 140*b*** -- therefor;
Line 41, delete "**130*d*" and substitute -- 130*b*** -- therefor;
Line 43, delete "**130*d*" and substitute -- 130*b*** -- therefor;
Line 66, delete "FIG. 2 is a diagrammatic plan view" and substitute therefor -- FIGS. 2A and 2B are top plan views -- therefor;

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

It is certified that error appears in the above-identified patent and that said Letters Patent is hereby corrected as shown below:

Column 12,
Line 1, after "roll" and before "of" insert -- 38 --;
Line 2, delete "38";
Line 21, delete "lower" and substitute -- second -- therefor;
Line 23, after "dog" and before "or" insert -- 118 --;
Line 25, delete "lower" and substitute -- second -- therefor;
Line 28, delete "lower" and substitute -- second -- therefor;
Line 32, delete "which";
Line 34, after "roll" and before "of" insert -- 38 --;
Line 35, delete "38";
Line 46, delete "lower" and substitute -- second -- therefor;
Lines 48-49, delete "upper end" and substitute therefor -- first edge --;
Line 50, after "item" and before "held" insert -- 14 --;
Line 54, delete "lower" and substitute -- second -- therefor;
Line 55, delete "upper" and substitute -- first -- therefor;

Column 13,
Line 3, delete "lower" and substitute -- second -- therefor;
Line 18, delete "50" and substitute -- 150 -- therefor;
Line 22, delete "50" and substitute -- 150 -- therefor;
Line 29, after "plant" and before "from" insert -- 12 --;
Line 37, after ""A"", delete "to the" and substitute -- (see FIG. 1) to the first and second --;
Line 42, after "material" and before "to" insert -- 150 --;
Line 44, delele “side” and substitute -- edge -- therefor;
Line 45, delete “side” and substitute -- edge -- therefor;
Line 54, delete “**146*a*.” and substitute -- 146*a* (FIG. 2A**). -- therefor;
Line 64, after “sheet” and before “may” insert -- 150 --;
Line 66, after “pot” and before “to” insert -- 12 --;

Column 14,
Line 38, after "sheet" insert -- **150*c*** --;

UNITED STATES PATENT AND TRADEMARK OFFICE

CERTIFICATE OF CORRECTION

PATENT NO. : 5,813,198
DATED : September 29, 1998
INVENTOR(S) : Donald E. Weder et al.

It is certified that error appears in the above-identified patent and that said Letters Patent is hereby corrected as shown below:

Column 15,
Line 4, delete "FIG. 19" and substitute -- FIG. 13 -- therefor;
Line 30, delete "cover," and substitute -- wrapper, -- therefor;
Line 35, delete "cover" and substitute -- wrapper -- therefor;
Line 35, delete "turntable," and substitute therefor -- turntable 114, --;
Line 38, delete "bottom" and substitute -- lower end 170 -- therefor;
Line 49, delete "grouping." and substitute therefor -- grouping 182. --;
Line 61, after "material" and before "is" insert -- 150 --;

Column 16,
Line 19, delete "the holding of" and substitute -- holding -- therefor;
Line 36, after "about" and before "outer" insert -- the --; and
Line 43, delete "pot." and substitute therefor -- potted plant. -- therefor.

This certificate supersedes Certificate of Correction issued December 25, 2001.

Signed and Sealed this

Fourteenth Day of January, 2003

JAMES E. ROGAN
*Director of the United States Patent and Trademark Office*